US010689834B2

(12) United States Patent
Levesque

(10) Patent No.: US 10,689,834 B2
(45) Date of Patent: Jun. 23, 2020

(54) METER PIT AND METHOD OF MANUFACTURING THE SAME

(71) Applicant: Kevin J. Levesque, Pittsford, NY (US)

(72) Inventor: Kevin J. Levesque, Pittsford, NY (US)

(73) Assignee: Bingham & Taylor Corp., Rocky Hill, CT (US)

( * ) Notice: Subject to any disclaimer, the term of this patent is extended or adjusted under 35 U.S.C. 154(b) by 87 days.

(21) Appl. No.: 15/911,927

(22) Filed: Mar. 5, 2018

(65) Prior Publication Data

US 2018/0251962 A1 Sep. 6, 2018

Related U.S. Application Data

(60) Provisional application No. 62/467,495, filed on Mar. 6, 2017.

(51) Int. Cl.

| | |
|---|---|
| ***E03B 7/09*** | (2006.01) |
| ***E02D 29/12*** | (2006.01) |
| ***E03B 9/10*** | (2006.01) |
| ***E03F 5/02*** | (2006.01) |

(52) U.S. Cl.

CPC ..... *E03B 7/095* (2013.01); *E02D 29/12* (2013.01); *E03B 9/10* (2013.01); *E03F 5/02* (2013.01)

(58) Field of Classification Search

CPC ..... E03B 7/095; B65D 88/76; B65D 88/06; B65D 90/004; B65D 90/105

USPC ..... 220/567.1

See application file for complete search history.

(56) References Cited

U.S. PATENT DOCUMENTS

| | | | | |
|---|---|---|---|---|
| 978,384 | A | 12/1910 | Lofton | |
| 1,133,386 | A | 3/1915 | Lofton | |
| 2,870,981 | A * | 1/1959 | Dellinger | B65D 19/004 108/52.1 |
| 3,026,076 | A | 3/1962 | Bender | |
| 3,060,693 | A | 10/1962 | Taylor | |
| 3,212,339 | A | 10/1965 | Rivero | |
| 3,443,436 | A | 5/1969 | Meyer | |
| 3,824,664 | A * | 7/1974 | Seeff | B21D 11/08 428/604 |
| 3,913,400 | A | 10/1975 | Floren | |
| 3,921,449 | A * | 11/1975 | Hauffe | G01F 15/14 73/273 |
| 4,014,475 | A | 3/1977 | Grace et al. | |

(Continued)

FOREIGN PATENT DOCUMENTS

| | | |
|---|---|---|
| EP | 0061908 A2 | 10/1982 |
| EP | 2461441 A1 | 6/2012 |

(Continued)

OTHER PUBLICATIONS

DFW®, www.dfwplasticsinc.com, 5 page, Jan. 2014.

"Municipal Water Market Products", © 2014 Oldcastle Precast, Inc. 12 pages.

*Primary Examiner* — Shawn M Braden

(74) *Attorney, Agent, or Firm* — St. Onge Steward Johnston & Reens, LLC

(57) ABSTRACT

A pit defining an opening and having a footing. Cutouts are located in the footing and are created in mold to avoid secondary cutting operations. The wall of the pit above the footing is narrower than the footing and includes ribs extending from the wall for added compressive resistance. The ribs may vary in size both in length and extension into the center of the pit.

22 Claims, 23 Drawing Sheets

(56) References Cited

U.S. PATENT DOCUMENTS

| | | | | |
|---|---|---|---|---|
| 4,207,768 | A | 6/1980 | Henss | |
| 4,278,115 | A | 7/1981 | Briles et al. | |
| 4,298,470 | A | 11/1981 | Stallings | |
| 4,344,645 | A | 8/1982 | Kirk | |
| 4,487,690 | A | 12/1984 | Logsdon | |
| 4,639,164 | A | 1/1987 | Pugnale et al. | |
| 4,669,305 | A | 6/1987 | Rivero-Olmedo | |
| 4,809,548 | A * | 3/1989 | Rivero-Olmedo | G01F 15/18 251/904 |
| 4,813,281 | A | 3/1989 | Daghe | |
| 4,852,403 | A | 8/1989 | Bednarz | |
| 4,872,338 | A | 10/1989 | Rivero-Olmedo | |
| 4,884,442 | A | 12/1989 | Rivero-Olmedo | |
| 5,037,239 | A | 8/1991 | Olsen et al. | |
| 5,045,352 | A | 9/1991 | Mueller | |
| 5,058,633 | A | 10/1991 | Sharp | |
| 5,076,456 | A | 12/1991 | Geyer | |
| 5,099,894 | A | 3/1992 | Mozeley, Jr. | |
| 5,271,518 | A | 12/1993 | Webb | |
| 5,298,894 | A | 3/1994 | Cerny et al. | |
| 5,361,930 | A | 11/1994 | Perry | |
| 5,441,082 | A | 8/1995 | Eskew et al. | |
| 5,718,537 | A | 2/1998 | Becker et al. | |
| 5,741,969 | A | 4/1998 | Sebastopoli | |
| 5,747,687 | A | 5/1998 | Edwards et al. | |
| 5,765,323 | A | 6/1998 | Bevilacqua | |
| 5,832,675 | A | 11/1998 | Zuares | |
| 5,878,907 | A * | 3/1999 | Graf | B65D 11/06 220/324 |
| 5,882,142 | A | 3/1999 | Siglin et al. | |
| 5,906,479 | A | 5/1999 | Hawes | |
| 6,164,131 | A | 12/2000 | Edwards et al. | |
| 6,181,294 | B1 | 1/2001 | Porter et al. | |
| 6,218,995 | B1 | 4/2001 | Higgins et al. | |
| 6,227,396 | B1 | 5/2001 | Small | |
| 6,262,685 | B1 | 7/2001 | Welch et al. | |
| 6,431,387 | B2 | 8/2002 | Piehler | |
| 6,581,940 | B2 | 6/2003 | Dittel | |
| 6,712,086 | B1 | 3/2004 | Fails | |
| 6,749,080 | B1 | 6/2004 | White | |
| 9,233,775 | B1 * | 1/2016 | Holbrook | E03F 1/003 |
| 2001/0033080 | A1 | 10/2001 | Dukes et al. | |
| 2006/0288778 | A1 | 12/2006 | Benner et al. | |
| 2010/0102547 | A1 | 4/2010 | Manuel | |
| 2011/0197975 | A1 * | 8/2011 | Stiatti | E02D 29/12 137/371 |
| 2015/0176239 | A1 * | 6/2015 | Ducote | E02D 29/14 137/377 |

FOREIGN PATENT DOCUMENTS

| | | | |
|---|---|---|---|
| EP | 3118957 | A1 | 1/2017 |
| WO | 2007035223 | A2 | 3/2007 |

* cited by examiner

METER PIT AND METHOD OF MANUFACTURING THE SAME

FIELD OF THE INVENTION

This following invention relates to a pit to contain and protect in ground plumbing and utility items such as valves, water meters, electrical equipment and the like. More particularly, the invention relates to an injection molded meter pit.

BACKGROUND OF THE INVENTION

Meter pits are generally known in roto-molded (from a rotational molding process) configurations. Due to these types of forming processes, the thickness of the walls of meter pits is often substantially uniform. Although the walls may be uniform, the stresses or design requirements in different parts of the meter pits may not be. This may result in too much material being used which is both wasteful and expensive. For example, U.S. Pat. No. 6,164,131 to Edwards shows an in-ground receptacle for fluid and meter valves which uses "a continuous wall" that is "co-molded in three layers" (Abstract). As can be seen in the figures of Edwards, (e.g. FIG. 2) the wall thickness is substantially uniform throughout. This results in wasted and inefficient use of material.

Meter, valve and other types of pits are typically buried in the ground where the footing of the meter pit is directly in contact with soil. The footing therefore needs to be wide enough to resist the tendency of the meter pit to settle further into the ground, which could damage the meter and/or plumbing.

Furthermore, meter pits (for municipal usage which are substantial in size and have demanding performance requirements, as opposed to those for lawn sprinklers which are relatively small and have minimal if any performance requirements) often require a crush force resistance of 20,000 Pounds Force (to support incidental vehicle traffic) which can dictate a wall thickness at the weakest point of the pit which in the roto-molding process would essentially require more or less a uniform thickness of the pit, which may not be ideal use of material, resulting in wasted material and increased cost.

In some cases, the footing is formed by folding over a sheet associated with the pit to create a flange extending outwardly from the wall of the pit. Although this may help prevent settling, when the flange is buried in the ground, it may be very difficult to remove or adjust the pit due to the flange being buried.

Prior art meter pits also suffer a disadvantage in that they commonly require post molding processing to form the final product. For example, some meter pits include holes at the bottom that allow plumbing lines to enter and exit there from. Roto-molded pits often require post molding cutting operations to open these holes. Such pits also need the primary top and bottom holes cut out which is a greater effort and a considerable waste of material. Potentially 10-25% or more of scrap that may not be reusable in another pit, often times because the roto-molding process is done with two plastics or two colors with the inside being white and the outside being black which means the waste may not be useful due for re-molding as the re-melted product would not be a combination of the two colors (i.e. grey).

It is therefore desirable to provide an improved meter pit that uses less material than prior art versions, avoids the tendency to settle further into the ground, reduces or eliminates post molding processing requirements and is strong and stiff enough to remain in operation.

SUMMARY OF THE INVENTION

One object of the invention is to provide a meter pit having varied wall thicknesses and reduced material requirements.

It is another object of the invention to include plumbing inlet holes in the meter pit while eliminating or reducing post processing cutting requirements.

It is another object of the invention to provide an injection molded meter pit that has both sufficient strength and short enough in mold cycle time to produce an inexpensive and reliable meter pit.

It is still another object of the invention to provide a meter pit that avoids settling of the pit without excessive cycle or cooling time during molding.

These and other objects are achieved by providing a pit defining an opening and having a footing. An upper flange (frame seat) to support a frame for the cover is also supplied. The flange may have sufficient strength to transfer up to a 20,000 pound load down the sidewalls of the pit, then to the foot and ultimately to the soil below the foot. The soil is often crushed rock or gravel of some sort, but not always. Cutouts are located in the footing (bottom of side wall) and are created in mold to avoid secondary molding operations. The wall of the pit above the footing is narrower than the footing and includes ribs extending from the wall for added compressive resistance. The ribs may vary in size both in length and extension into the center of the pit (thickness). Ribs can vary in width as well.

In one aspect a pit is provided for installation in the ground to house utility items, plumbing devices, valves, meters or the like. The pit includes a wall defining inner and outer surfaces and extending between top and bottom ends. A footing has a height and is located at the bottom end of the wall. A face of the footing defines a surface transverse to an axis of the wall. The face further defines inner and outer edges. The wall and the footing are formed by injection molding and a top section of the wall has a width less than a distance between the inner and outer edges of the footing. A plurality of holes extend from the face and into the footing such that a total volume of the plurality of holes is at least 20% of a volume of the footing. These holes may not be required in all designs.

In some cases, the total volume of the plurality of holes is at least 25%, at least 30% or more of the volume of the footing. A plurality of ribs may extend inwardly from the wall. The ribs may extend at a rib distance at least equal or greater than the width of the top section where the width of the top section is measured adjacent to the ribs in a space between two of the ribs. In some cases the rib distance or thickness is at least 1.1 to 1.5 or at least twice the width of the top section. In certain embodiments the rib width is larger than the wall thickness, for example 10%-50% wider or more particularly 15-25% wider however, in other embodiments, the width is thinner than the wall thickness. Certain preferred embodiments the rib width is in the range of 50% or 30% or 25% or 10% lower than to 50% or 30% or 25% or 10% higher than the wall thickness. The rib width is measured perpendicular to the thickness at the base of the rib on the inside of the wall of the pit. In preferred embodiments, the thickness of the rib (i.e. amount it extends into to the pit) is minimized to maximize internal working volume and work space. The width of the ribs in preferred embodiments is greater than the wall thickness.

The pit may include a cutout in the footing extending from the face towards the top section and between the inner and outer surfaces at the footing. There may be two cutouts, one to receive the incoming plumbing/utility line and the other for outgoing plumbing/utility lines. In particular embodiments, the footing extends the footing flange around the cutout holes so that the flange is not interrupted. This maintains mechanical integrity of the part where a saw cut hole weakens a part due to the absence of the structural flange where the saw cut hole was made.

In other aspects a mold for manufacturing a pit having a height is provided. The mold includes first and second mold sections. A male portion of the first mold section extends from a face of the first mold section along an axis of the pit a first distance at least 50% or more of the height. A female portion of the second mold section extends between two faces at a second distance substantially equal to the height and the female portion defines a peripheral surface that corresponds to the wall of the pit. A male portion of the second mold section defines a center section extending along the axis a third distance equal to a difference between said first and second distances. When the mold is closed, this male portion of the second mold section contacts the male portion of the first mold section. At least one section of the male portion extends perpendicular to the axis between the center section and the peripheral surface has a width such that a footing void or cutout is defined in a space between the center section and the peripheral surface and adjacent to the at least one section.

In some cases the mold includes a plurality of channels located in the male portion of the first mold section. These channels correspond to the ribs of the pit. In some cases the plurality of channels extend in a plane common to the axis.

The mold may include a plurality of pins extending into the footing void. The pins may include an internal channel configured to receive a coolant therein in order to cool a material injected into the footing void. These pins correspond to the holes that in the footing to allow for removal of volume in the footing.

In other cases, a gate flange void is located within the mold where the second surface and the face meet in a closed configuration of the mold. The gate flange void extends around a peripheral edge of the male portion of the second mold section.

In some cases at least one cutting member is movable along the axis and within the mold to cut material disposed in the gate flange void. The cutting may occur before the material in the gate flange void has cooled or solidified. There may be two cutting members, a first positioned in the male portion of the second mold section and a second cutting member is positioned in the male portion of the first mold section. The cutting member(s) may be configured as a ring. Although certain embodiments disclosed herein are generally round or cylindrical pits, square and/or rectangular pits are also contemplated.

In other aspects a method of manufacturing the pit is provided. The method may include providing a first mold section including a first male section having a first end and a peripheral surface with a plurality of channels therein. The male section extends along an axis at a first distance less than the height. The method further includes providing a second mold section including a second male section with a second end extending a second distance substantially equal to a difference between the height and the first distance. The method further includes providing a plurality of pins extending into a void between the second male section and the second peripheral surface. The method further includes closing the first and second mold sections together to create a cavity and injecting a plastic into the cavity to create an injection molded pit having a wall, and a footing located at a bottom end of the wall. The footing defines an end face with face voids therein, the face voids accounting for at least 20% of a(n) volume of the footing.

In some aspects, the method includes introducing a coolant into channels located in the plurality of pins.

Other objects of the invention and its particular features and advantages will become more apparent from consideration of the following drawings, claims and accompanying detailed description. It should be noted that, while various functions and methods have been described and presented in a sequence of steps, the sequence has been provided merely as an illustration of one advantageous embodiment, and that it is not necessary to perform these functions in the specific order illustrated. It is further contemplated that any of these steps may be moved and/or combined relative to any of the other steps. In addition, it is still further contemplated that it may be advantageous, depending upon the application, to utilize all or any portion of the functions or combinations of functions described herein.

DETAILED DESCRIPTION OF THE INVENTION

Figure 1:
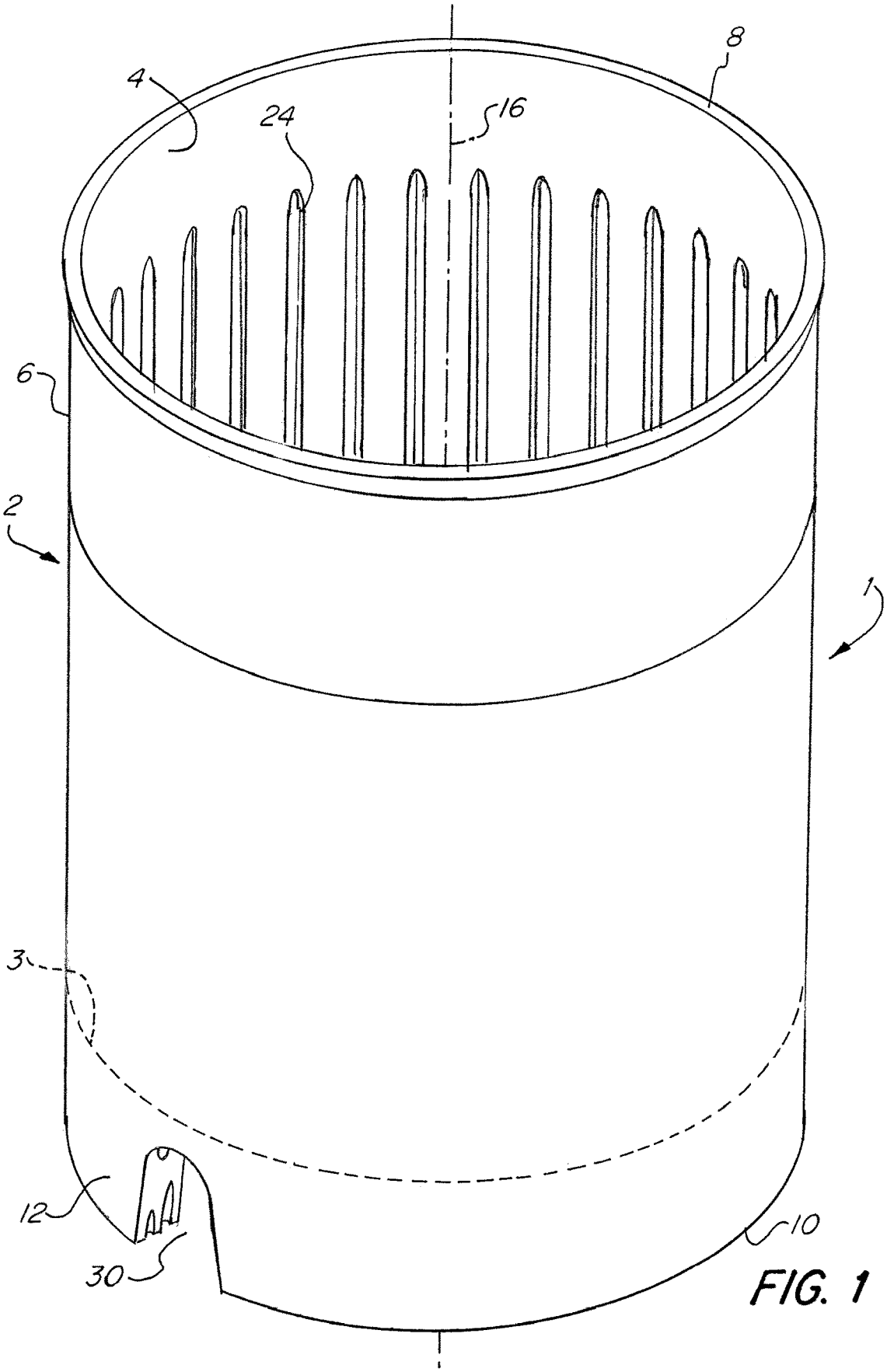
FIG. 1 is a perspective view of an exemplary pit.

Referring now to the drawings, wherein like reference numerals designate corresponding structure throughout the views. The following examples are presented to further illustrate and explain the present invention and should not be taken as limiting in any regard.

Referring to FIGS. 1-5, the pit includes a wall 2 defining inner 4 and outer 6 surfaces, the wall 2 extending between top 8 and bottom 10 ends. Ribs 24 may extend from the inner surface 4 and these ribs may provide increased compressive stiffness to the pit. In some cases, it is contemplated that the ribs could be located around and extend from the outer surface 6 in addition or instead or the ribs 24 shown extending inwardly. The bottom end of the pit includes a footing 12. This footing includes a face 14 that generally is in contact with the ground/soil. The width of the footing is designed to resist or prevent settling of the pit once installed. This is because some of the pits may be installed directly against soil, gravel or other loose pack type of material rather than being embedded in concrete. It is contemplated that the pits shown and described herein could also work when embedded in concrete.

Figure 2:
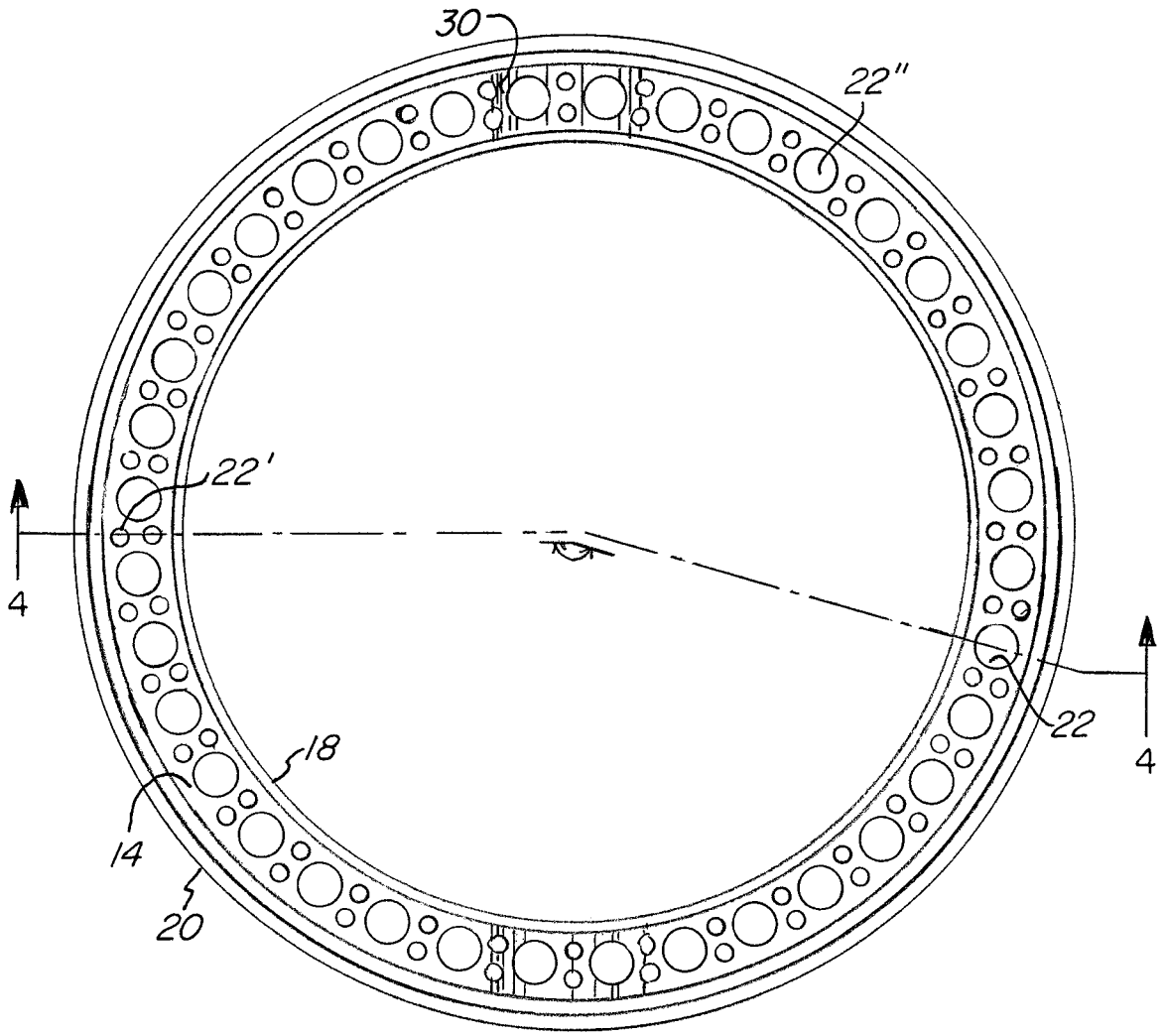
FIG. 2 is a bottom view of FIG. 1.

The cutout 30 in the footing 12 extends between the inner and outer surfaces at the footing and generally perpendicular to the axis 16 of the pit. Although the pit is shown with two cutouts on opposite ends, it is contemplated that other locations and additional or even fewer cutouts 30 could be used, depending on the application. The pit shown has two cutouts 30, one could be for incoming and the other could be for outgoing, for example incoming water pipes and outgoing water pipes may be connected on either side of the valve/meter that is located within the pit. The bottom view of the cutout 30 is shown in FIG. 2 where the cutout extends into the page. The holes 22 also extend between the top of the cutout and the top of the footing. In certain embodiments the cutouts are of different sizes.

The face 14 of the footing defines an area between the inner 18 and outer edges 20 of the footing. The top of the footing is shown in dashed line 3. Holes 22, 22' etc in the footing reduce the amount of material used to make the footing. For example, the empty volume defined by the holes 22, 22' etc may be 10-70% of the volume between the inner 18 and outer edges 20 and up to the top of the footing 3. In some preferred embodiments, the empty volume may be 20-50% or 35-45% of the volume of the footing. In addition to reducing the material requirements of the pit, the holes allow for easier molding and shorter molding cycles. Since injection molding typically uses hot, molten plastic, significant contractions in dimensions can be expected during molding as thickness increases. In addition, increased thickness takes longer times to cool, which can increase cycle time in molding to be too long. The holes significantly reduce the thickness of the footing, while still providing sufficient remaining volume and width between the inner 18 and outer 20 edges to prevent/resist settling of the pit when installed.

Figure 3:
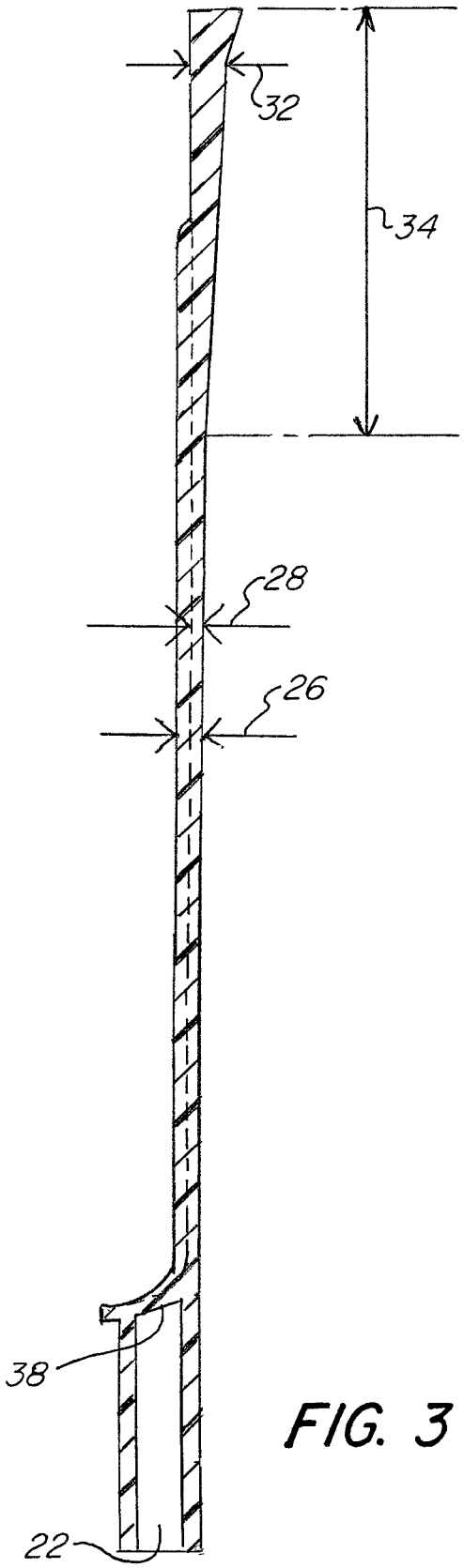
FIG. 3 is a detail cross section view of FIG. 1 along line 4-4 shown in FIG. 2.
Figure 4:
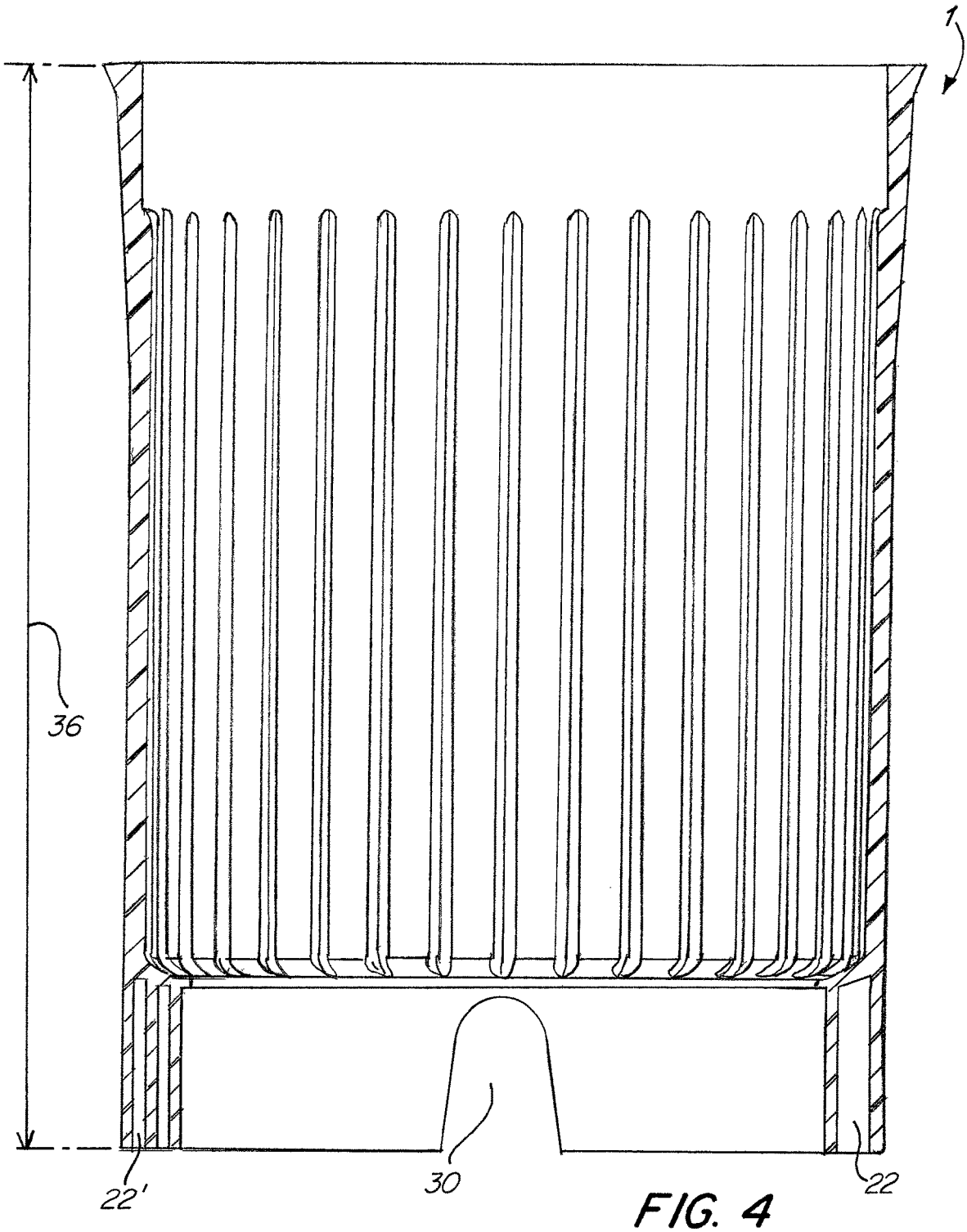
FIG. 4 is a cutaway view of FIG. 1 along line 4-4 shown in FIG. 2.
Figure 5:
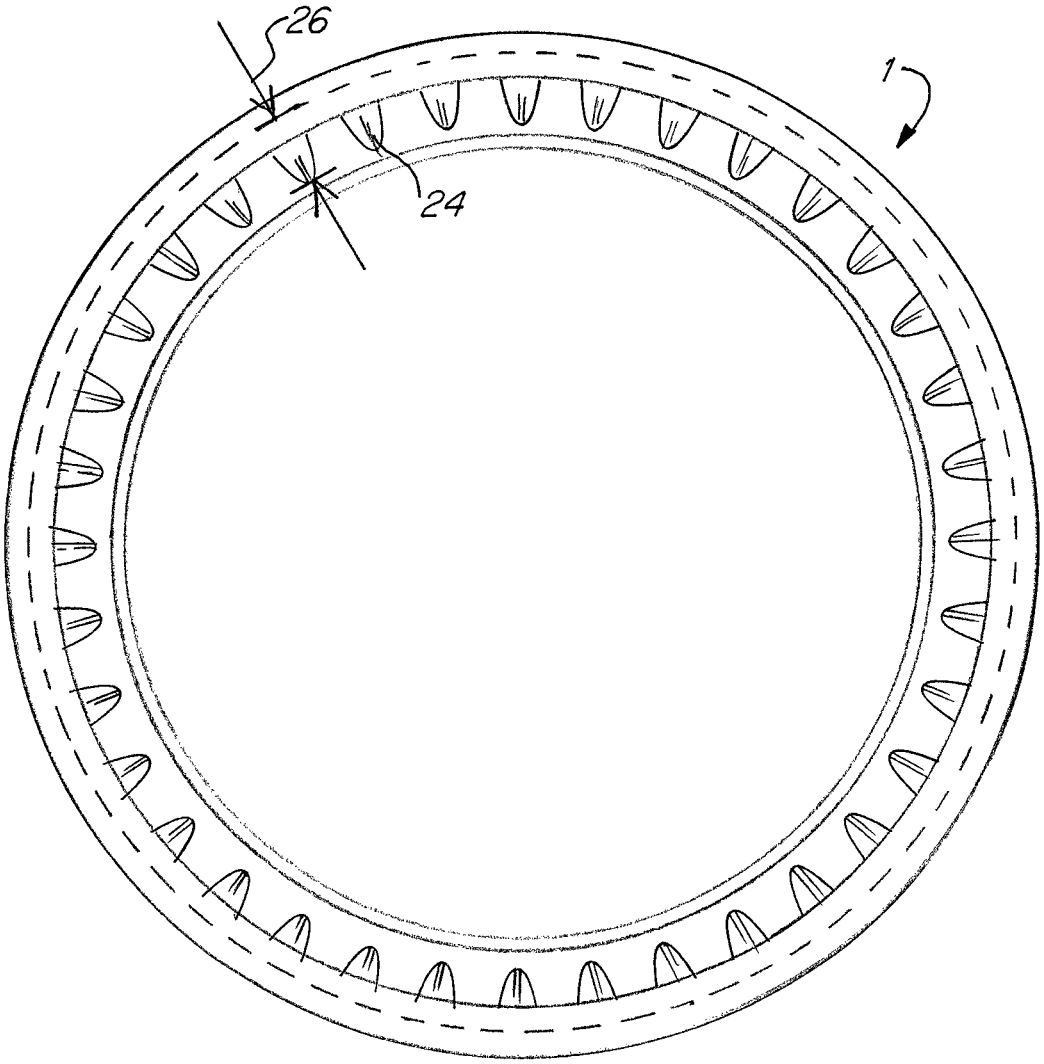
FIG. 5 is a top view of FIG. 1.

The rib 24 is shown extending at a distance 26. The distance 26 may be half to twice as large or larger as the wall thickness 28 between ribs. As shown, the wall 2 tapers from top 8 towards the bottom 10 and the top wall thickness 32 may be 10-80% larger than the wall thickness 28 between the ribs. The taper distance between the top 8 and the point where the wall thickness 28 is reached may extend down the wall 10-50% of the height 36, preferably in the rage of 20-30%. Hole 22" is also shown in FIG. 3. It is contemplated that the hole 22" may be tapered and narrow from bottom 10 towards the top 38 of the hole. In preferred embodiments the width of the ribs measured at the base thereof (perpendicular to distance 26) is greater than the wall thickness, particularly greater by at least 7% or more preferably 15-25% more than the wall thickness.

Figure 6:
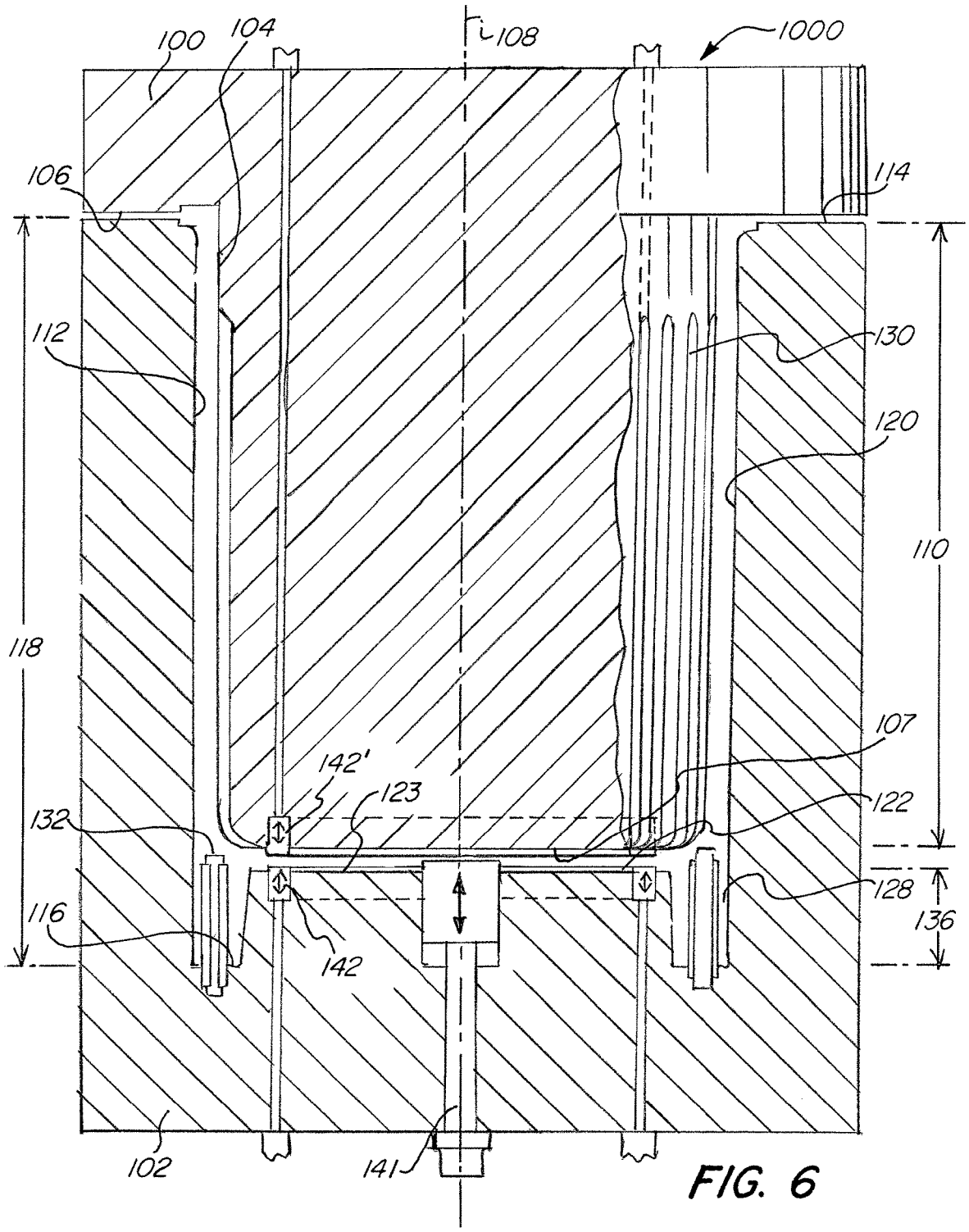
FIG. 6 is a cross section view of a mold for making the pit of FIG. 1.

Referring to FIG. 6, the mold 1000 for manufacturing the pit 1 is shown having first 100 and second 102 sections. The first section includes a male portion 104 which extends from face 106 to face 107 along axis 108. The male portion 104 extends a distance 110 that may be less than the height 36 of the pit 1. In some embodiments, the distance 110 is between 50-95% of the height 36. In some embodiments, the distance 110 is in the rage of 80-95% of the height 36. The second section 102 of the mold includes a male portion 122 that extends a distance 136. In some preferred embodiments, the sum of distance 136 and distance 110 is substantially equal to height 36 such that when the mold is face 107 and surface 123 are in contact and face 106 and face 114 are also in contact.

As shown, the female portion 112 of the second mold section 102 extends between faces 114 and 116 a distance 118 and distance 118 may be substantially equal to the height 36 of the pit. The female portion 112 defines a peripheral surface 120 that corresponds to the outer surface of the wall 2 of the pit 1. Channels 130 in the male portion 104 correspond to ribs 24 as well.

Figure 7:
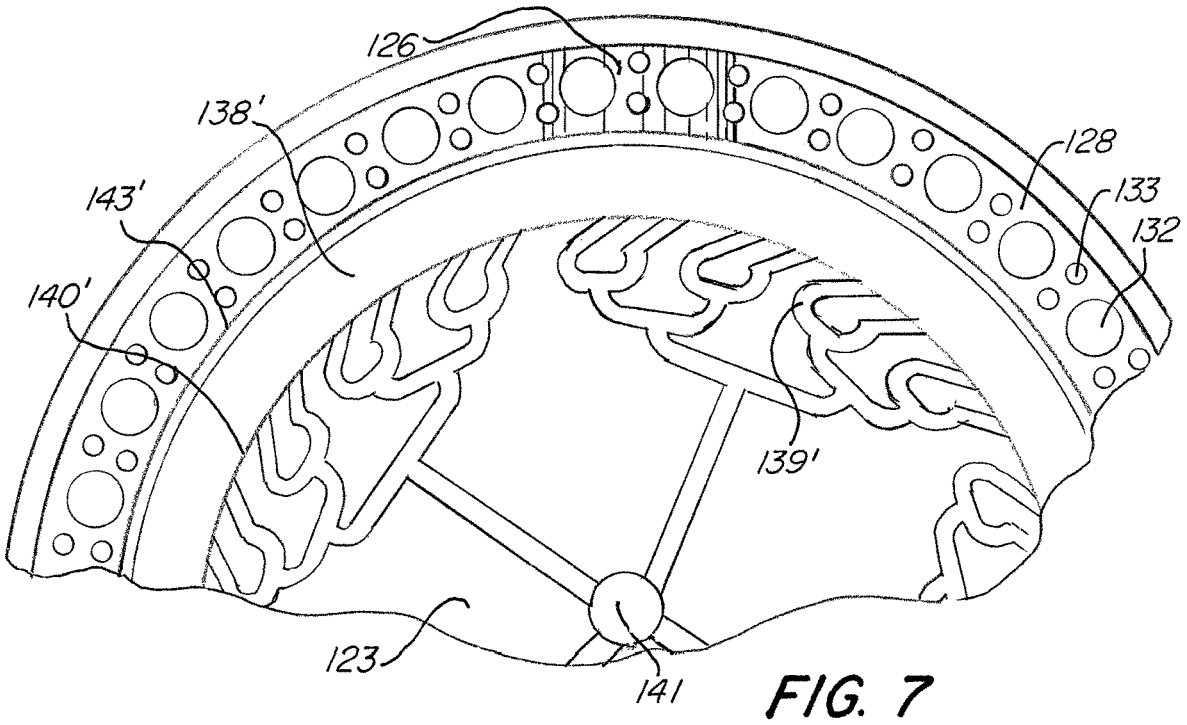
FIG. 7 is a top detail view of part of the mold of FIG. 6

As seen in FIG. 7, the face 123 of mold portion 102 includes channels 139 therein. The channels 139' lead to flange 138' which narrows at 143'. The channels/flange shown in the face 123 may also be located in face 107. As one example, channels 139' may be semi-circular such that when the mold halves are closed, a circular passage is created. Section 126 of the mold extends in the direction out of the page and corresponds to the cutout 30.

Figure 8:
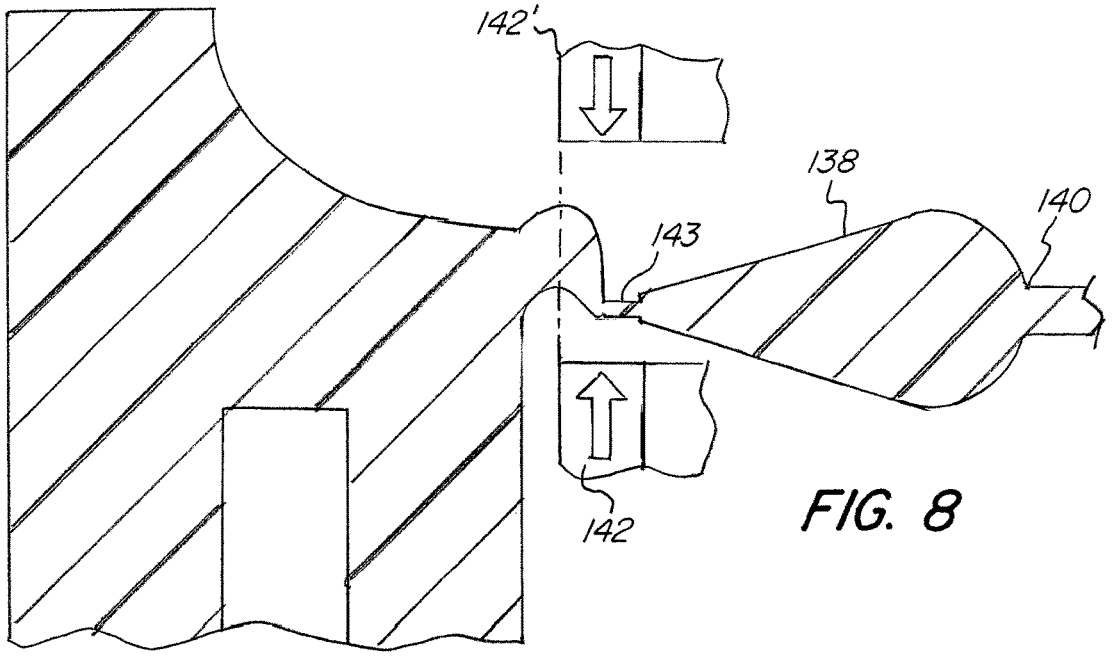
FIG. 8 is a detail side cross section view of the pit of FIG. 1 during molding.
Figure 9:
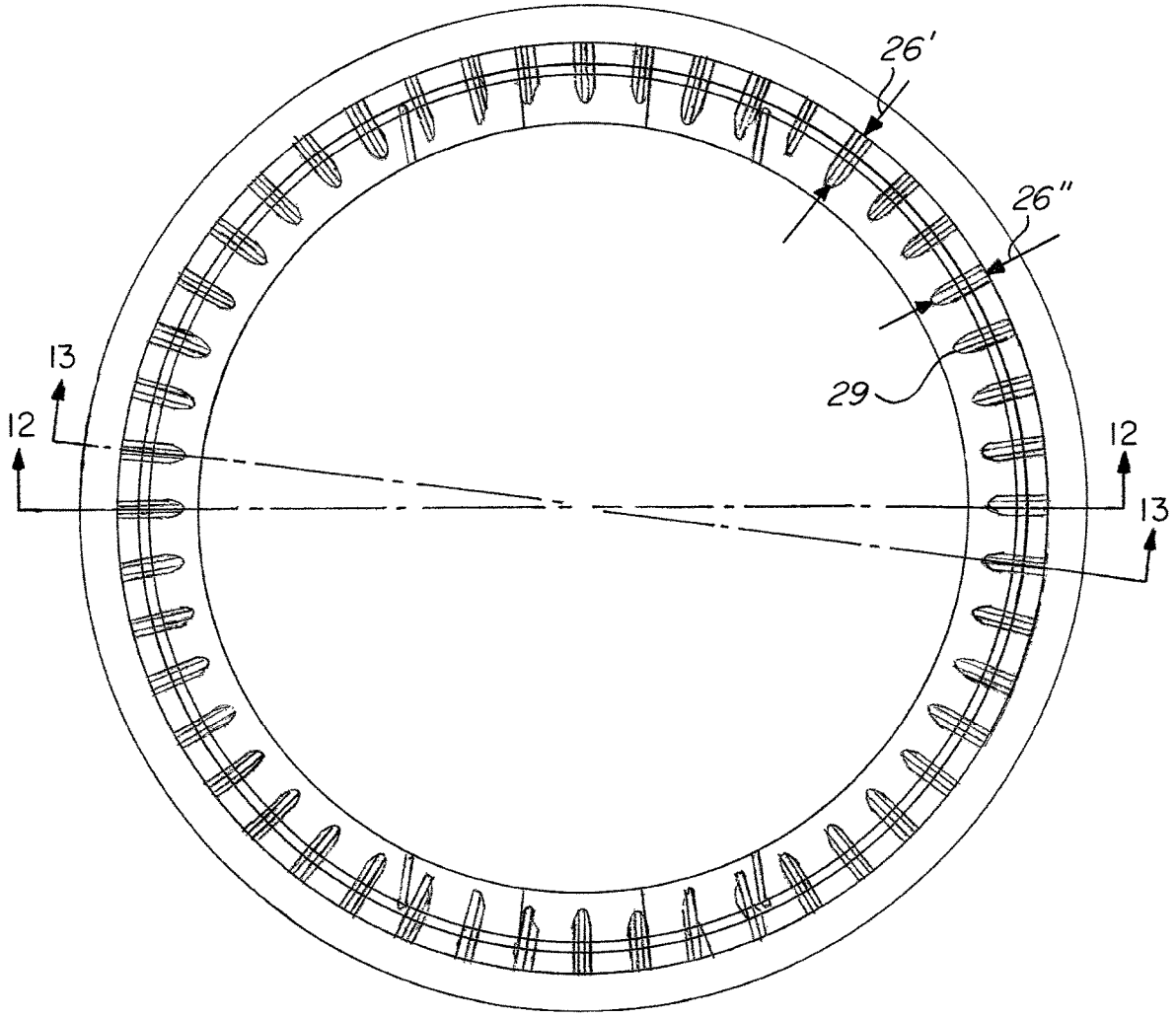
FIG. 9 shows a top view of a pit according to the present invention.
Figure 10:
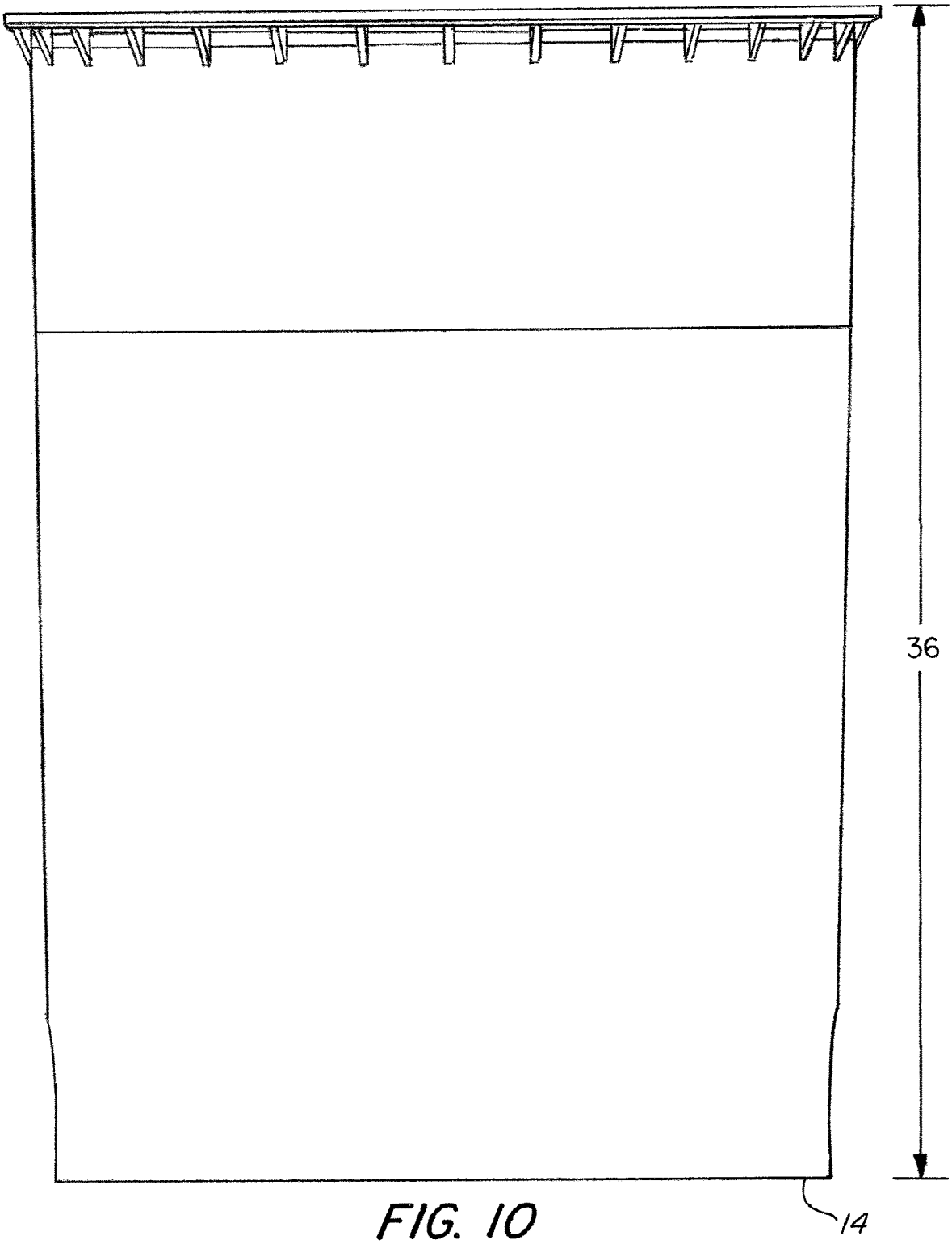
FIG. 10 shows a side view of a pit according to FIG. 9.
Figure 11:
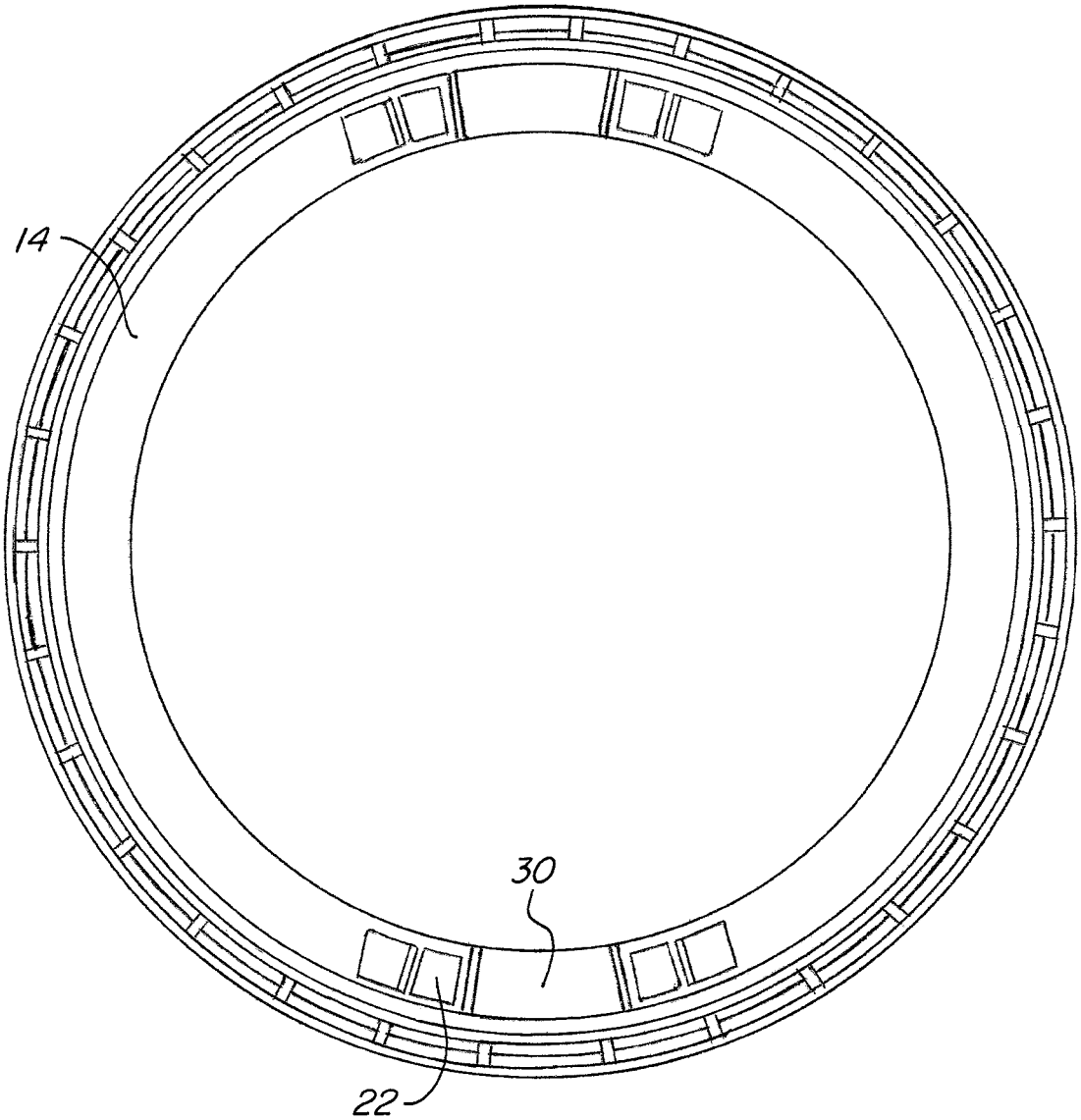
FIG. 11 shows a bottom view of a pit according to FIG. 9
Figure 12:
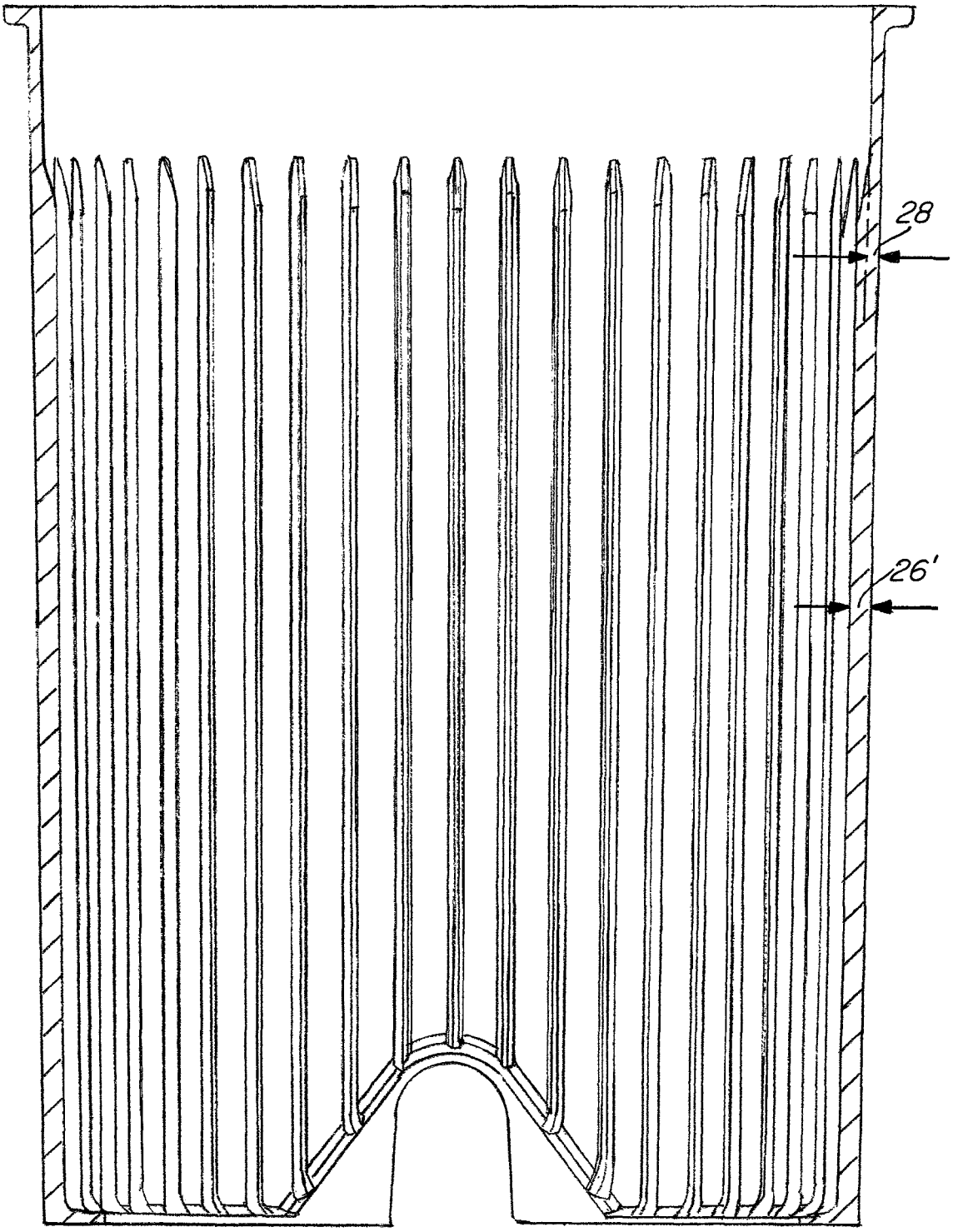
FIG. 12 shows a section along 12-12 in FIG. 9
Figure 13:
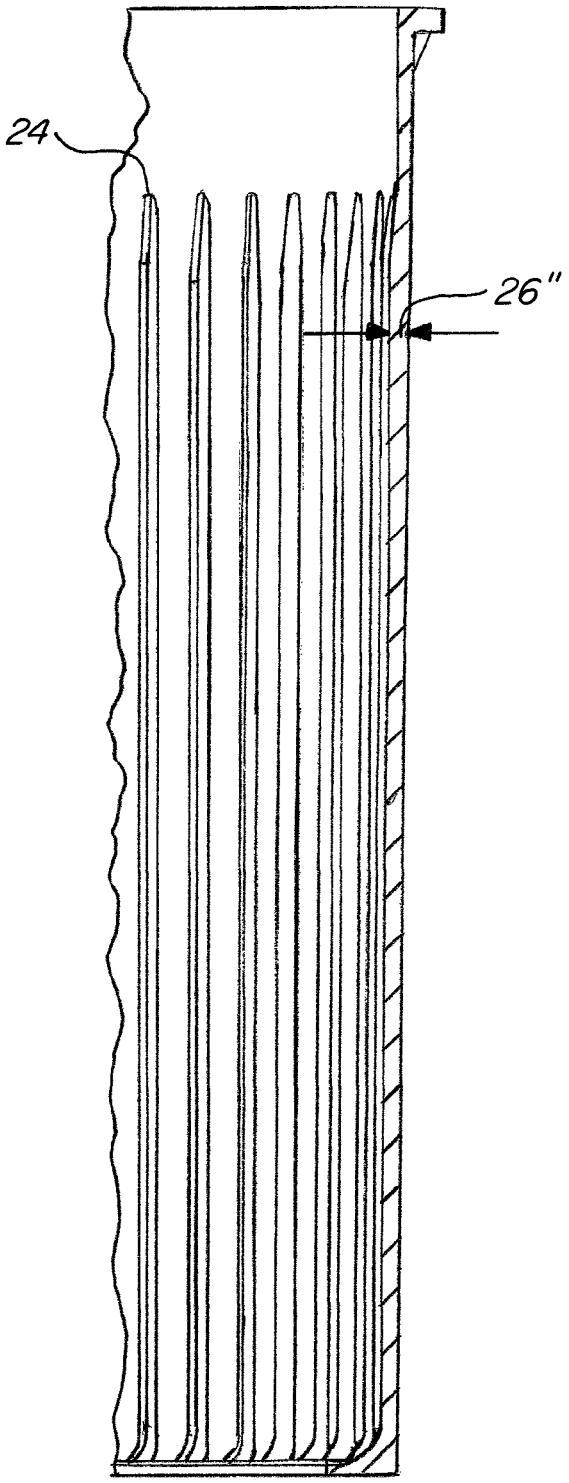
FIG. 13 shows a section along 13-13 in FIG. 9
Figure 15:
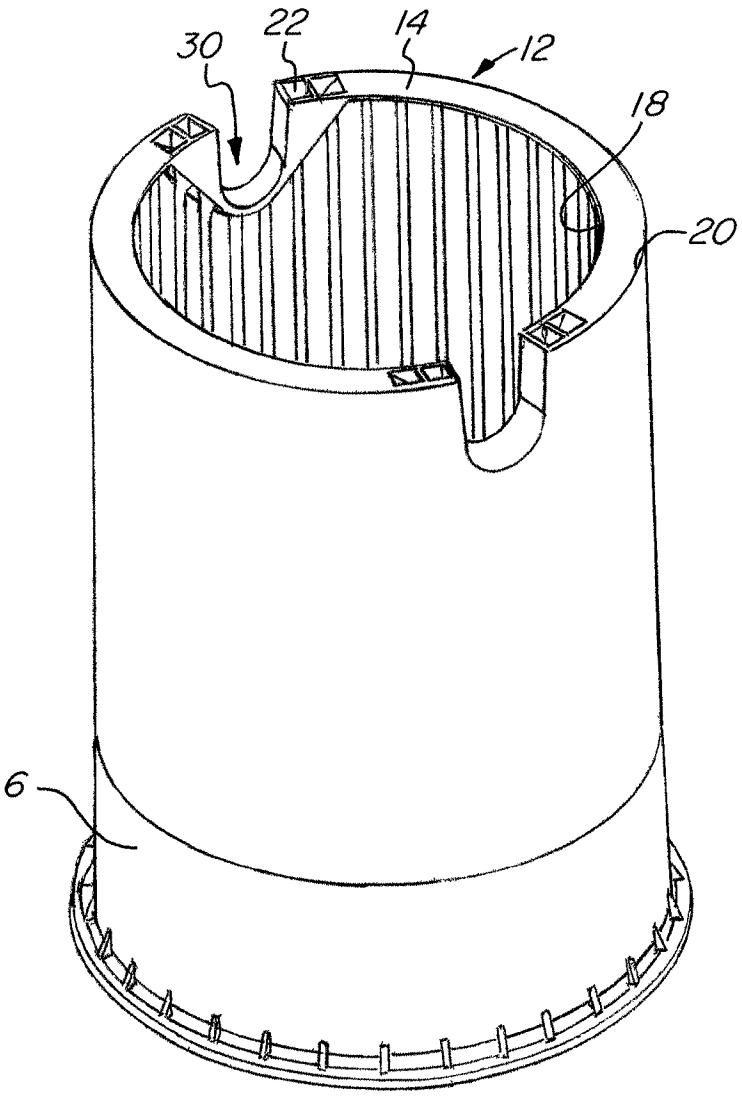
FIG. 15 shows a bottom perspective view of a pit according to FIG. 9.
Figure 14:
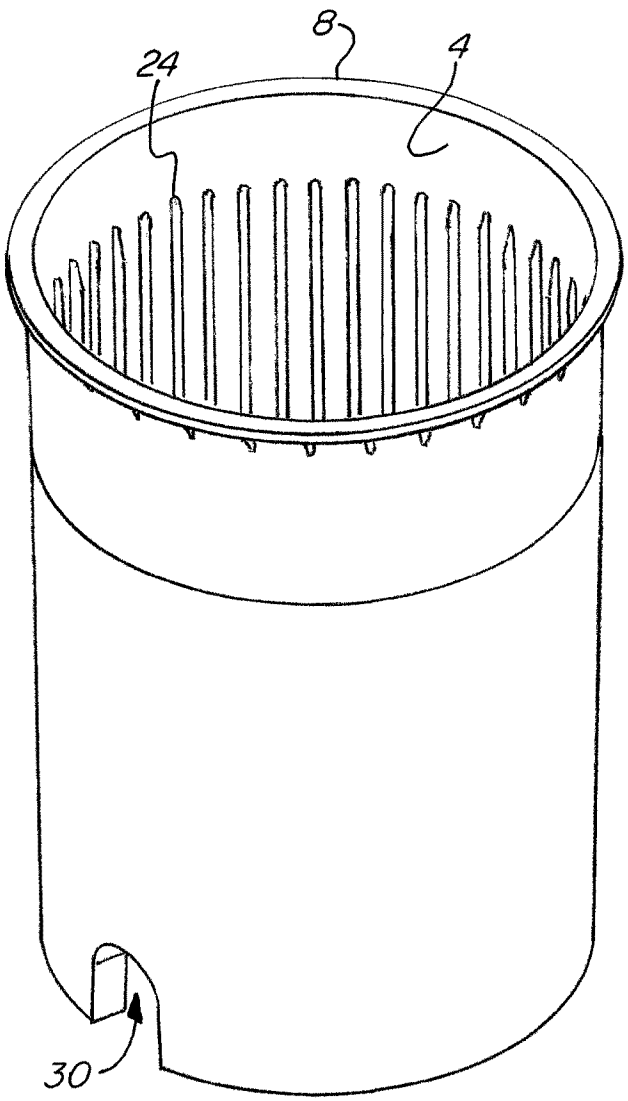
FIG. 14 shows a top perspective view of a pit according to FIG. 9.
Figure 16:
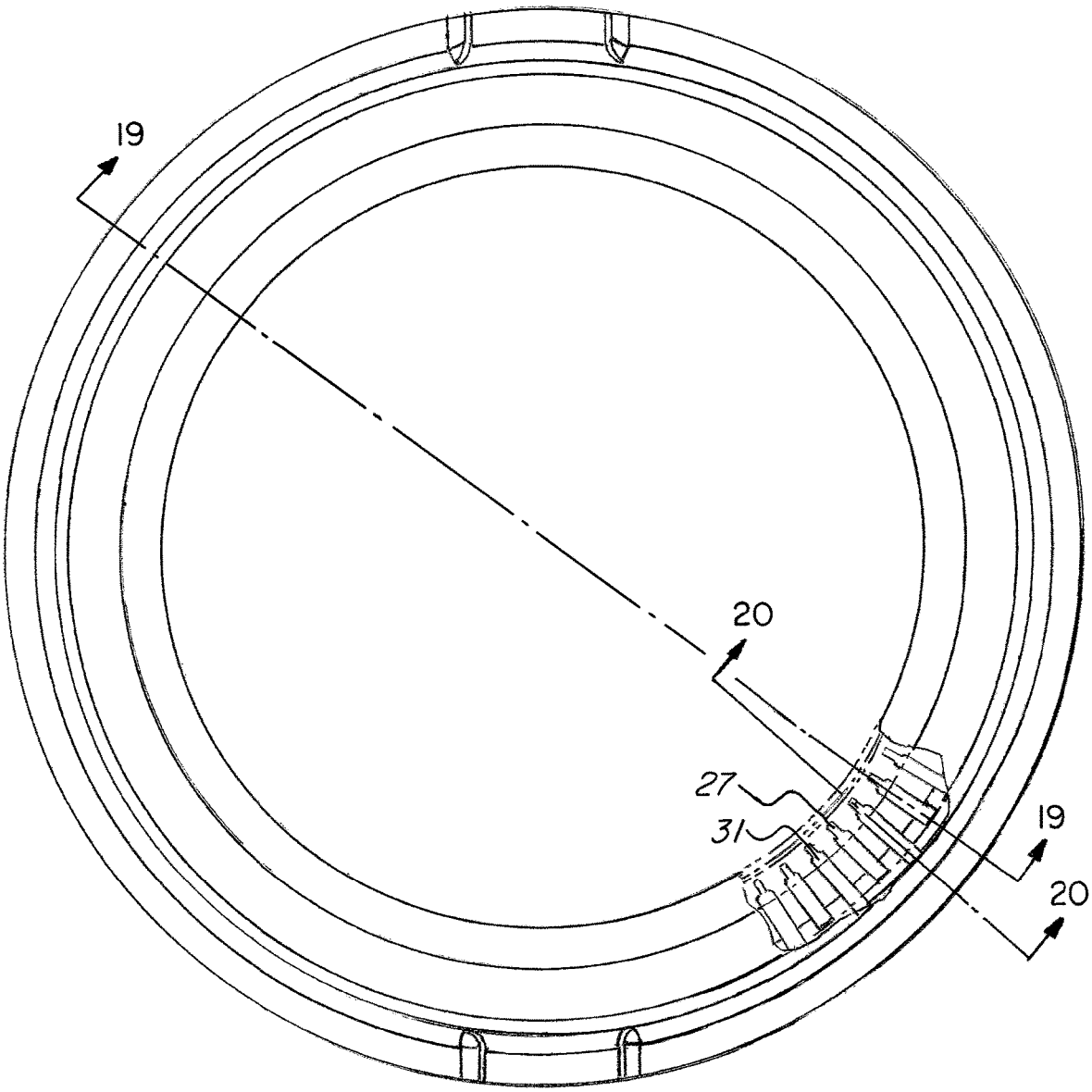
FIG. 16 shows a top view of a pit according to the present invention.
Figure 17:
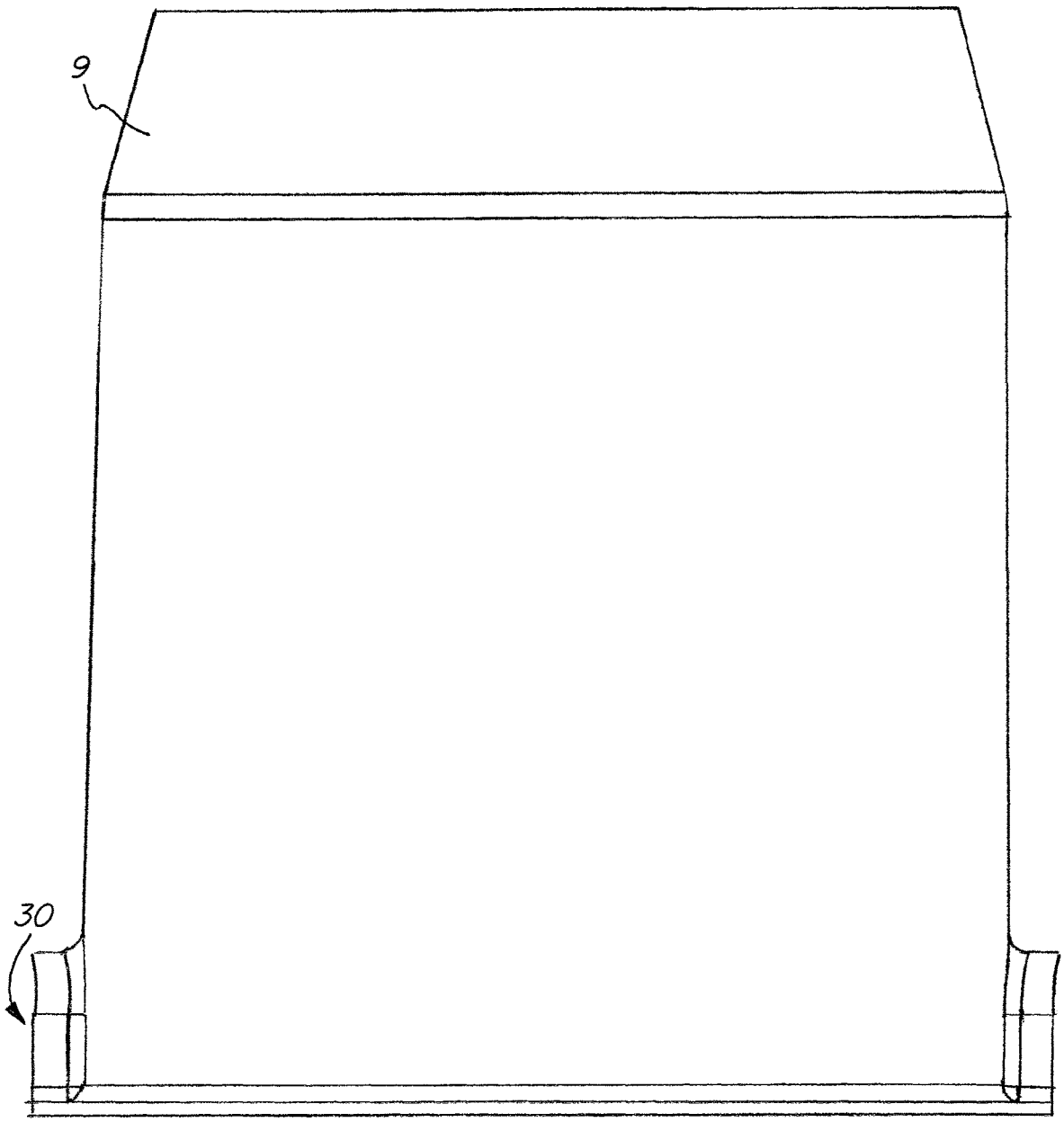
FIG. 17 shows a side view of a pit according to FIG. 16
Figure 18:
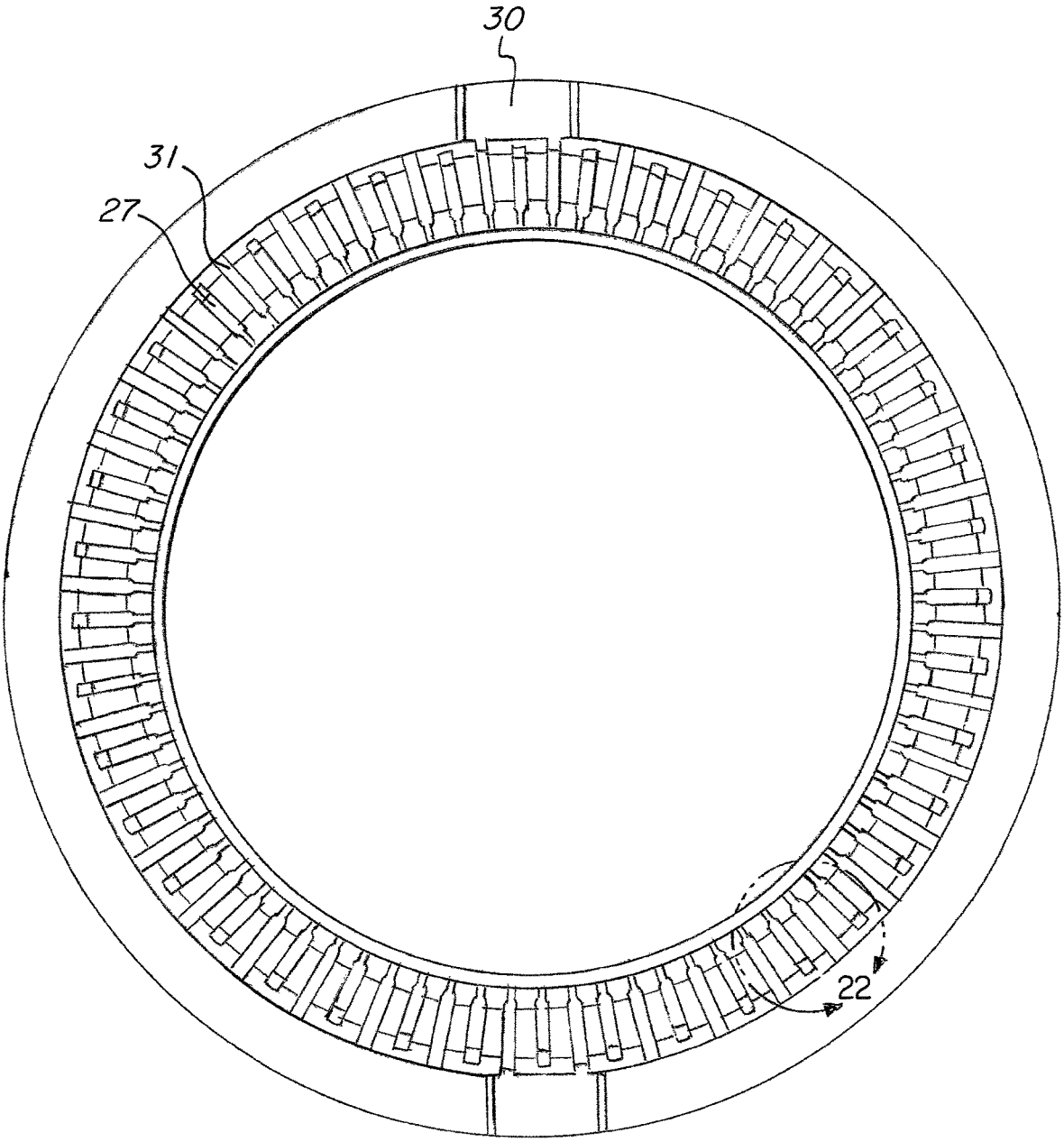
FIG. 18 shows a bottom view of a pit according to FIG. 16.
Figure 19:
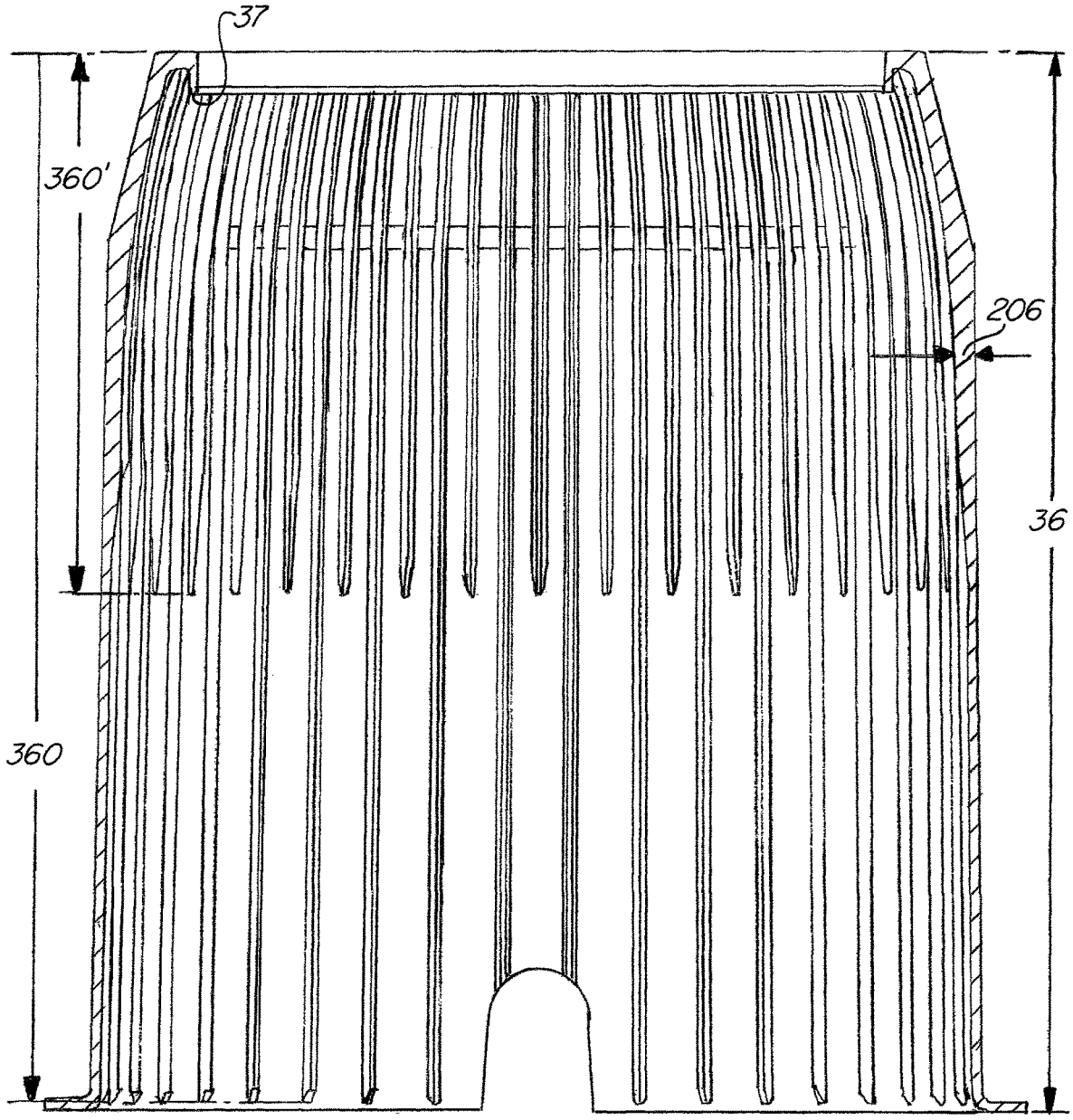
FIG. 19 shows a section view along 19-19 as shown in FIG. 16.
Figure 20:
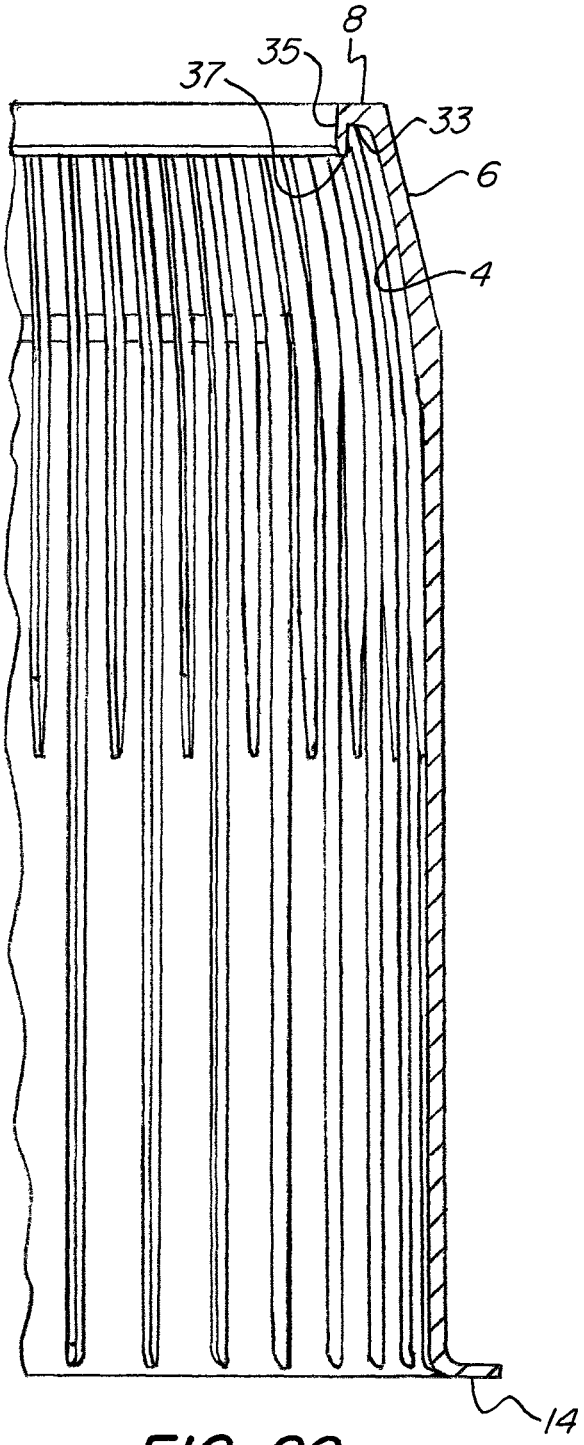
FIG. 20 shows a section view along 20-20 as shown in FIG. 16
Figure 21:
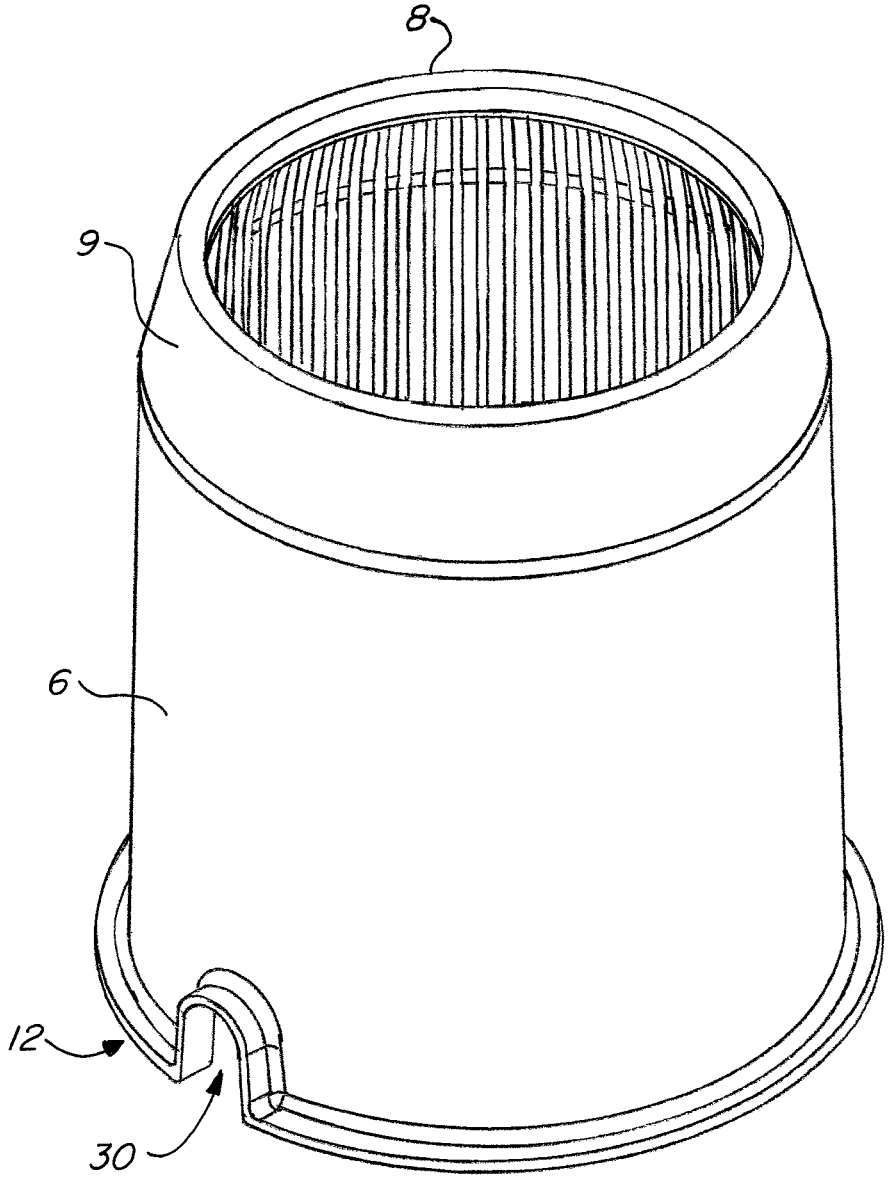
FIG. 21 shows a top perspective view of a pit according to FIG. 16.
Figure 22:
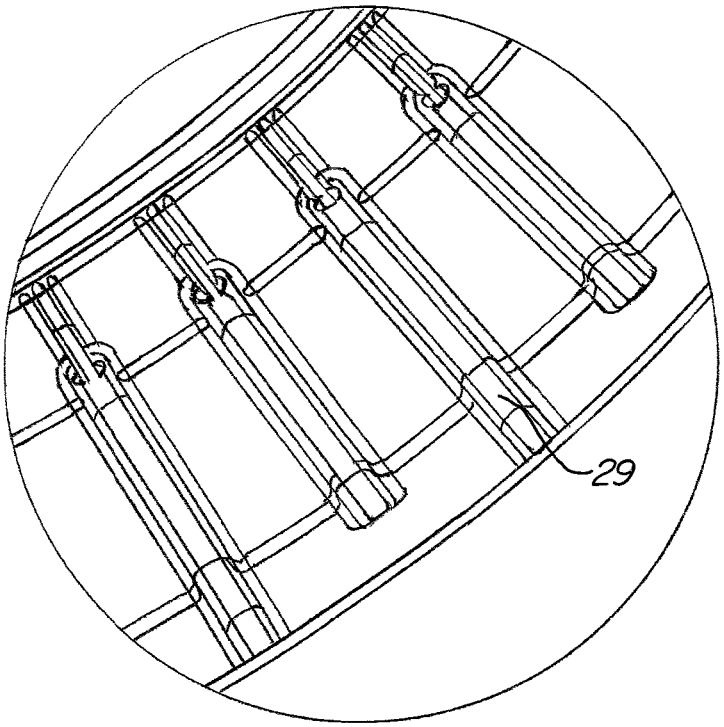
FIG. 22 shows detail 22 of FIG. 18.

FIG. 8 shows a cross section of the resulting flange 138 that is made when plastic is injected into the mold. The flange 138 is shown increasing in width from section 140 to flange 138 which then narrows again to section 143. The flange 138 and sections 140/143 correspond to the channels shown in FIG. 7 and the channels in the opposite face 107 of the other mold half. This may smooth the flow of plastic into the flange. Cutting members 142/142' may be moved together after injection of the plastic but before the plastic has cooled. Injection port 141 receives molten plastic therein during injection molding which distributes molten plastic throughout the channels 139' etc.

A section 126 of the male portion 122 of the second mold section 102 extends generally perpendicular to axis 108 to create the cutout 30 during molding. Additional sections 126 may be positioned to create additional cutouts, depending on the application desired. A footing void 128 is located between the section 126 and the surface 120 in the area where the footing 12 is created during molding. Within the footing, pins 132/133 extend therein. The pins may be tapered and may also move separately within holes in the mold section 102 to allow for easier removal of the part from the pins 132/133. The pins 132/133 may also be hollow or include channels that allow for circulation of a coolant. Since the footing 30 may generally be the thickest volume on the part, additional cooling via the pins is helpful in reducing cycle time. The pins also reduce the total volume of material required to make the footing while keeping the inner 18 and outer 20 edges of the footing spaced apart sufficiently to resist/prevent settling when the pit is installed in the ground.

It is understood that cutting member 142/142' is in the shape of a ring. During molding, the plastic is injected into the pit 1 and before the pit 1 fully cools, the cutting member 142/142' is/are moved to cut the gate flange at the appropriate location. Since the pit is partially molten when cut, weld lines are avoided and a post mold processing is avoided. The cutting member may have a sharpened blade or may be merely a ring with a face at 90 degrees to the outer surface of the ring. It is contemplated that one or two cutting members 142/142' may be used, and these may move together during molding to perform the cutting operations.

Referring to FIGS. 9-15 an alternate embodiment of the pit is shown. In this embodiment, the ribs 26' and 26" vary in thickness. Particularly, the embodiment shown has 48 ribs, 24 of which are short (26") and 24 of which are long (26'). As can be seen, the ribs alternate between long and short. Particularly, the long ribs have a thickness of 0.47 inches as measured from the outer wall whereas the short ribs are 0.36 inches. The typical wall thickness is 0.2 inches. The ribs also include a squared off inner face 29 with corner fillets. Furthermore, the footing 12 is provided by an inward radial projection which creates surface 14 to contact the ground. Two holes 30 are provided such that utility lines can enter the pit—for example a water line. Holes 22 which extend into the surface 14 reduce the volume at the holes 30.

Referring to FIGS. 16-22 a further embodiment is shown having a tapered section 9 adjacent to the top 8. This tapered section accounts for less than 40% of the height 36 of the pit. Furthermore, ribs 27 and 31 alternate around the inner surface of the pit. Rib 27 extends to about 50% of the height 36 and rib 31 extends substantially the entire height 36. The rib thickness in the embodiment shown is 0.44 inches whereas the wall thickness is 0.2 inches. In this embodiment the footing 12 is defined by a flange that extends outwardly from the outer surface 6 at the bottom of the pit. In this embodiment, the wall thickness is about 0.2 inches with the rib thickness of about 0.44 inches (including the wall thickness). The difference between the inner and outer diameters at the footing 12 is about 3 inches—thus the footing extends about 1.5 inches outwardly. The ribs also include a flat face 29. Furthermore, below the top 8 of the part in this embodiment, there is a void 33 between the inner flange 35 and the inner wall 4. As can be seen, inner flange 35 extends downwardly from the top 8 and terminates at an end 37. The end 37 is where the molten plastic is fed into during molding and where the mold gate is cut from the part. The shorter set of ribs start at the top and end about 14.66 inches from the bottom. The longer ribs extend substantially the entire length of the pit which is 30 inches in one embodiment.

Figure 23:
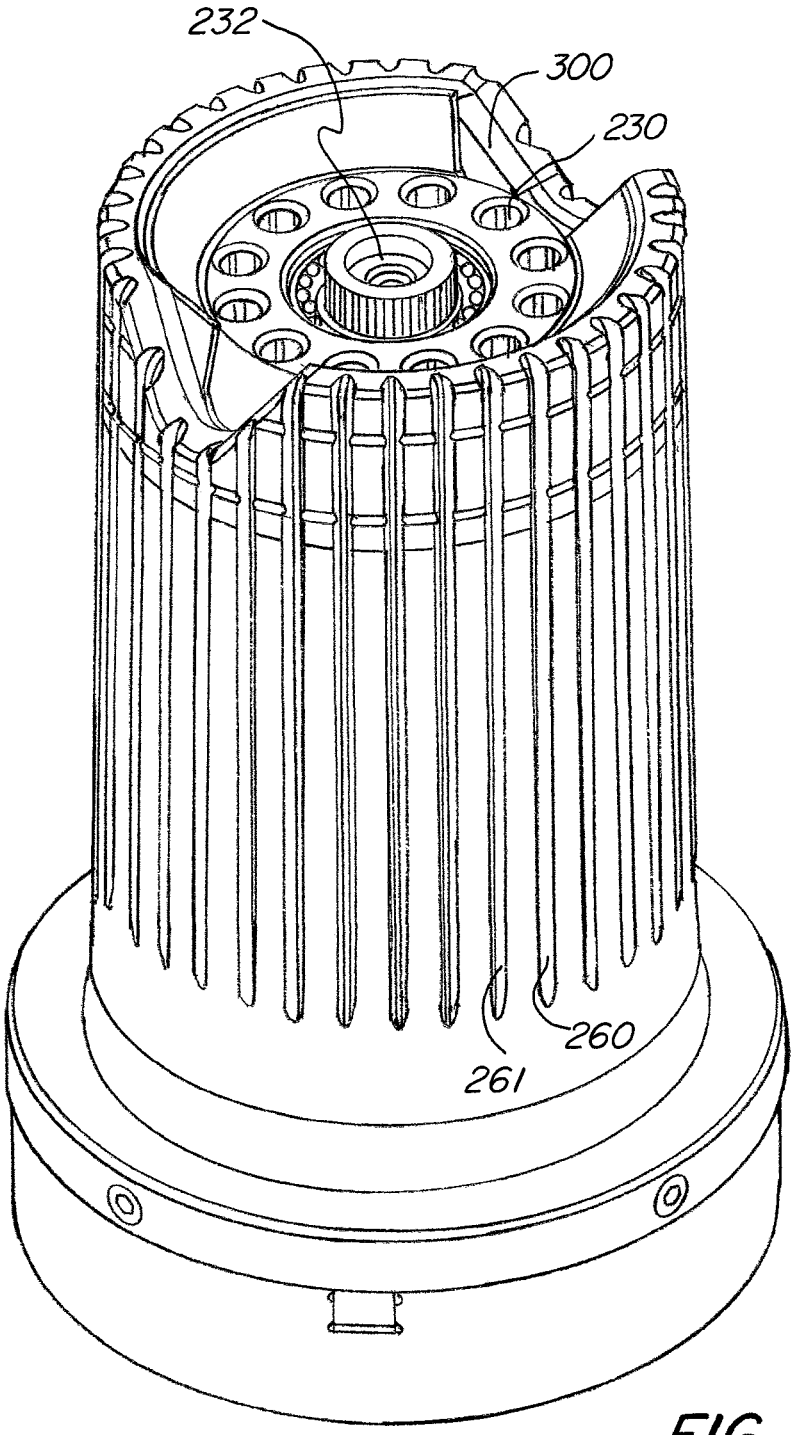
FIG. 23 shows a perspective view of part of a mold according to the present invention.
Figure 24:
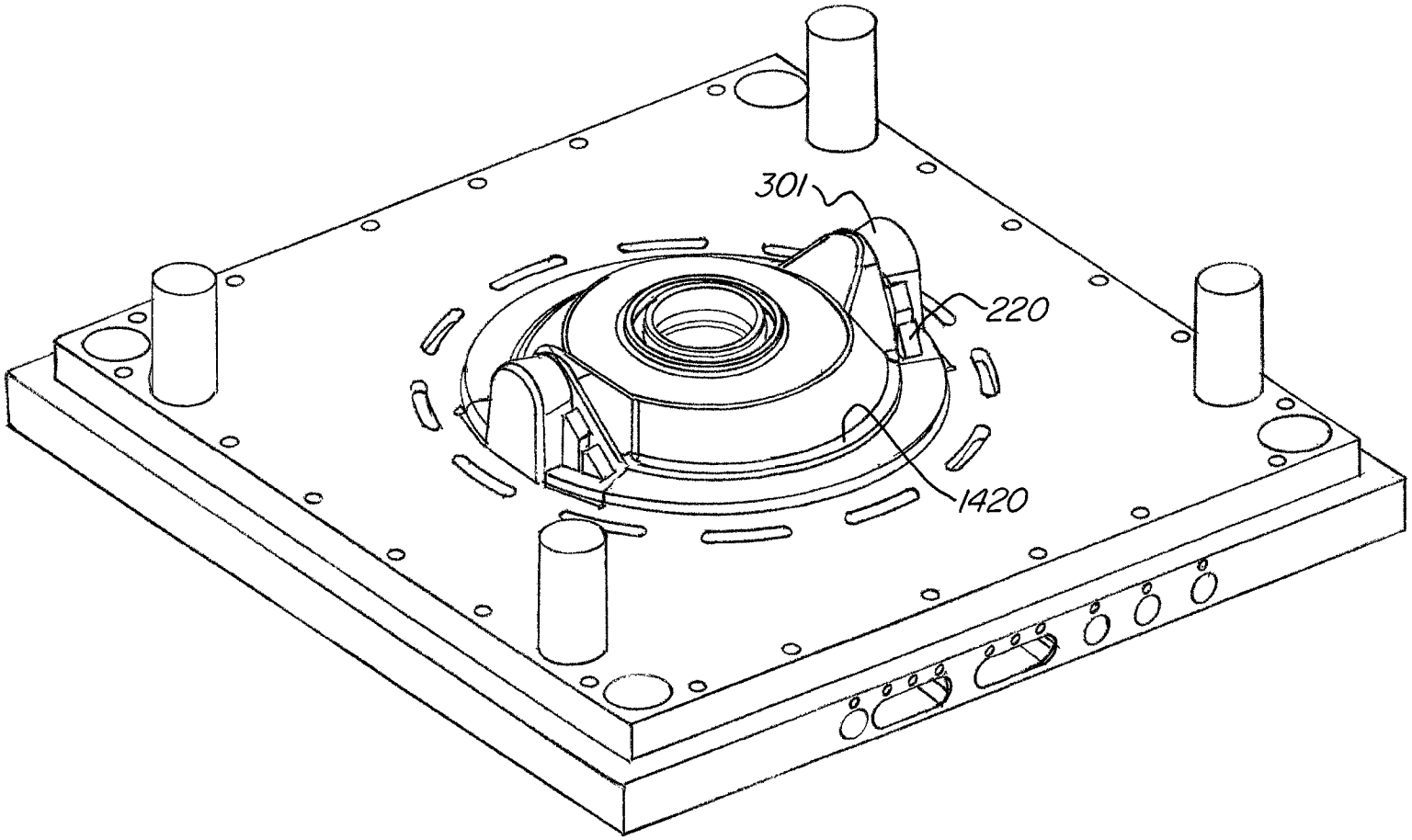
FIG. 24 shows a perspective view of another part of the mold of FIG. 23.
Figure 25:
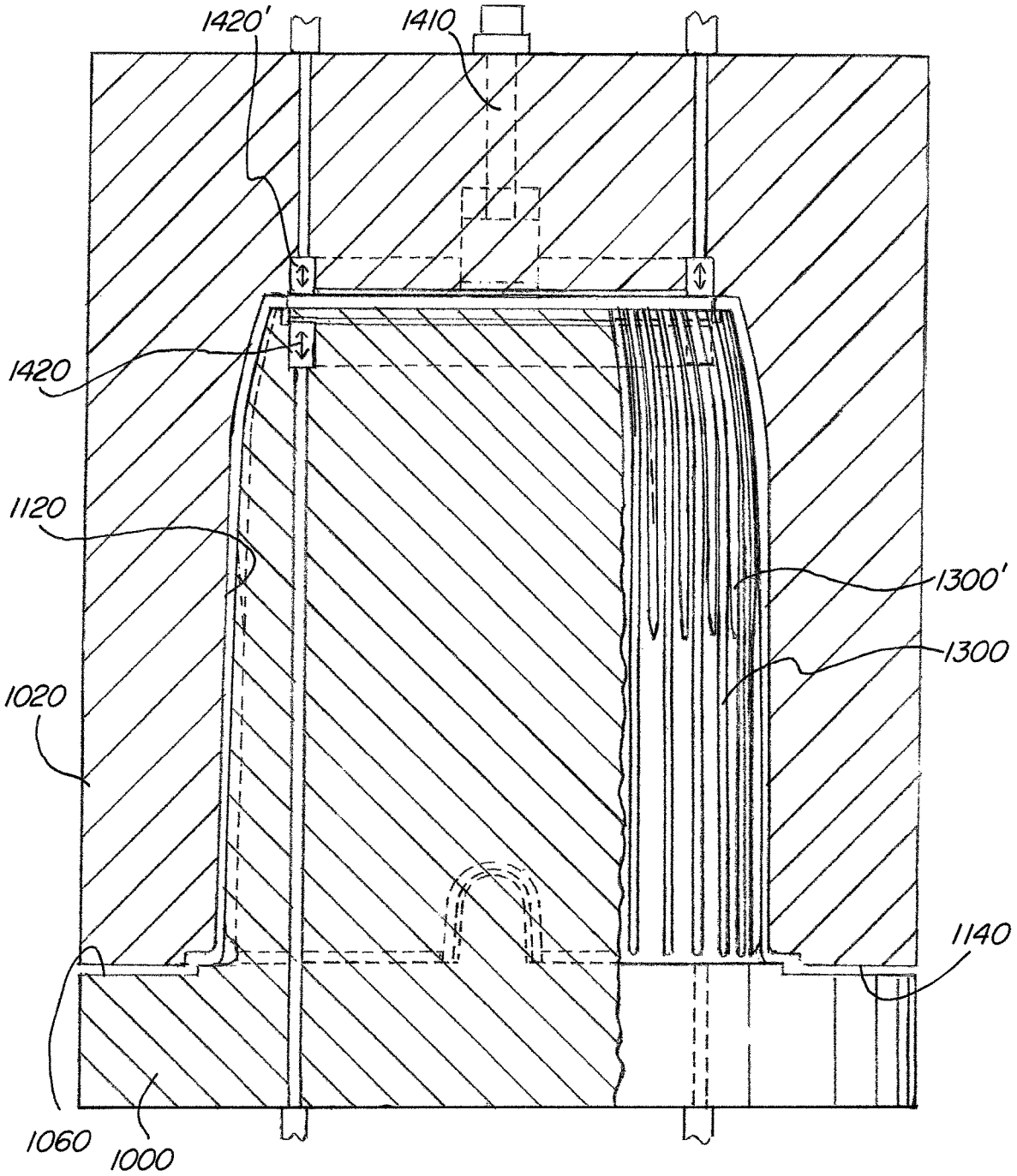
FIG. 25 shows a cross section view of another mold according to the present invention.

FIGS. 23-25 show various features of the mold used to create certain embodiments of the pit shown and described herein. Particularly, the pit of FIGS. 9-15 is made in accordance with the mold of FIGS. 23-24 and the mold of FIGS. 16-22 with the mold of FIG. 25.

Referring to FIG. 25, the mold is shown having first 1000 and second 1020 sections. The first section includes a male portion which extends a distance that may be less than the height of the pit. Channels 1300' and 1300 are provided in the male section and channels 1300' extend about half the height of the pit whereas channels 1300 extend about the full length of the pit. The second section 1020 of the mold surrounds the male portion such that the space therebetween can be filled with molten plastics to create the pit. The first and second sections have a tapered section which creates the tapered upper section of the pit.

Referring to FIG. 23, the channels 261 and 260 may be of different depths and may alternate around the circumference of the male section such that the ribs of the pit extend different distances into the center of the pit. Recess 300 creates the opening or mouse hole for the pit that is designed to receive plumbing or other entering utility lines that feed/exit the valve/meter that is positioned in the pit.

In particular aspects, the embodiments of the pits described herein are to have a crush force of approximately 20,000 lbf for a 30 inch high pit. In many cases, the 20,000 lbf is required regardless of the height or diameter of the pit if the pit is for municipal use and rated for incidental traffic. The volume of the part ranges from 450-800 cubic inches or more particularly between 500 and 650 cubic inches which is a substantial reduction vs an equivalently sized roto-molded meter pit. Thus the crush force/volume ratio is greater than 20 lbf/cubic inch or more specifically in the range of 20-50 lbf/cubic inch or more particularly 25-45 lbf/cubic inch. Thus, the pits are provided with high crush forces in relation to their volume (and likewise weight). In certain cases, a small meter pit such as an 18" diameter and 24" tall pit may weigh only 13 pounds but is still required to withstand the 20,000 lbf load. This part would be about 400 cubic inches.

In certain cases, the ribs are in two groups because engineering work found that using primary ribs supported by secondary ribs was a much more efficient use of material than making all of the ribs the same size. The secondary ribs are designed to feed load/stress to the primary ribs. The dimension of the primary ribs helps prevent buckling under load. The ribs are designed to economize materials while having sufficient anti-buckling resistance. The mode of failure under the 20,000 lbf load described herein is typically buckling. In certain embodiments, the pits described herein are made of a polyolefin material, or more particularly polypropylene copolymer or high density polyethylene.

Although the invention has been described with reference to a particular arrangement of parts, features and the like, these are not intended to exhaust all possible arrangements or features, and indeed many other modifications and variations will be ascertainable to those of skill in the art. It is further contemplated that various features of each of the embodiments disclosed herein may be incorporated into other embodiments.

It should be noted that the various parameters, dimensions and relationships between structural parts described as to particular embodiments may be employed in others, thus just because a particular dimension, characteristic or feature is described as to one embodiment, this disclosure expressly contemplates such features and relationships being employed in other embodiments.

What is claimed is:

1. A pit for installation in the ground to house utility items, plumbing devices, valves or meters, the pit comprising:

a wall defining inner and outer surfaces and extending between top and bottom ends and defining an inner opening extending between the top and bottom ends;

a footing having a height and located at the bottom end of the wall and further having a face, the face defining a surface transverse to an axis of the wall and the face further including inner and outer edges;

wherein said wall and said footing are formed by injection molding;

a top section of the wall having a width less than a distance between the inner and outer edges;

a plurality of ribs positioned along the wall and extending inwardly, a rib thickness measured from the outer surface to an innermost section of the rib wherein the rib thickness is 1.25-4 times a wall thickness between the inner and outer surfaces between two of said plurality of ribs;

wherein the plurality of ribs include first and second groups of ribs which alternate around the inner surface of the pit wherein the first group of ribs has a different length than the second group of ribs as measured along the axis of the pit.

2. A pit for installation in the ground to house utility items, plumbing devices, valves or meters, the pit comprising:

a wall defining inner and outer surfaces and extending between top and bottom ends and defining an inner opening extending between the top and bottom ends;

a footing having a height and located at the bottom end of the wall and further having a face, the face defining a surface transverse to an axis of the wall and the face further including inner and outer edges;

wherein said wall and said footing are formed by injection molding;

a top section of the wall having a width less than a distance between the inner and outer edges;

a plurality of ribs positioned along the wall and extending inwardly, a rib thickness measured from the outer surface to an innermost section of the rib wherein the rib thickness is 1.25-4 times a wall thickness between the inner and outer surfaces between two of said plurality of ribs wherein the plurality of ribs include first and second groups of ribs which alternate around the inner surface of the pit wherein the first group of ribs has a different rib thickness than that of the second group of ribs.

3. The device of claim 1 wherein the first group of ribs have a first length which is at least 80% of the distance between the bottom and top ends and the second group of ribs have a second length which is at least 25% of the distance between the bottom and top ends.

4. The device of claim 1 wherein at least some of the plurality or ribs have a first length which is at least 80% of the distance between the bottom and top ends.

5. The device of claim 1 wherein at least some of the plurality or ribs have a first length which is at least 90% of the distance between the bottom and top ends.

6. A pit for installation in the ground to house utility items, plumbing devices, valves or meters, the pit comprising:

a wall defining inner and outer surfaces and extending between top and bottom ends and defining an inner opening extending between the top and bottom ends;

a footing having a height and located at the bottom end of the wall and further having a face, the face defining a surface transverse to an axis of the wall and the face further including inner and outer edges;

wherein said wall and said footing are formed by injection molding;

a top section of the wall having a width less than a distance between the inner and outer edges;

a crush force between the bottom and top ends of the pit in pounds force is at least 20 times a volume in cubic inches of material which makes up pit.

7. The device of claim 6 wherein the wall includes a tapered section which tapers outwardly from the top towards the bottom.

8. The device of claim 7 wherein the tapered section accounts for at least 5% of the height of the pit.

9. The device of claim 8 wherein the wall is substantially parallel to a central axis of the pit below the tapered section.

10. A pit for installation in the ground to house utility items, plumbing devices, valves or meters, the pit comprising:

a wall defining inner and outer surfaces and extending between top and bottom ends and defining an inner opening extending between the top and bottom ends;

a footing having a height and located at the bottom end of the wall and further having a face, the face defining a surface transverse to an axis of the wall and the face further including inner and outer edges;

wherein said wall and said footing are formed by injection molding;

a top section of the wall having a width less than a distance between the inner and outer edges;

at least one side hole extending through the wall at the bottom end;

a plurality of ribs positioned along the wall and extending inwardly, a rib thickness measured from the outer surface to an innermost section of the rib wherein the rib thickness is 1.25-4 times a wall thickness between the inner and outer surfaces between two of said plurality of ribs;

a crush force between the bottom and top ends of the pit in pounds force is at least 20 times a volume in cubic inches of material which makes up pit.

11. The pit of claim 10 wherein the at least one side hole includes two side holes which are positioned at opposite sides of the wall such that the two side holes align through a center of the wall.

12. The device of claim 9 wherein the plurality of ribs include first and second groups of ribs which alternate around the inner surface of the pit wherein the first group of ribs has a different rib thickness than that of the second group of ribs.

13. The device of claim 10 wherein the plurality of ribs include first and second groups of ribs which alternate around the inner surface of the pit wherein the first group of ribs has a different lengths than the second group of ribs as measured along the axis of the pit.

14. The device of claim 13 wherein the first group of ribs have a first length which is at least 80% of the distance between the bottom and top ends and the second group of ribs have a second length which is at least 25% of the distance between the bottom and top ends.

15. The device of claim 10 further comprising a flange at the top end extending outwards of the outer surface of the wall and defining a second face parallel to the face.

16. The device of claim 10 wherein the plurality or ribs have a first length which is at least 90% of the distance between the bottom and top ends.

17. The device of claim 10 wherein the wall includes a tapered section which tapers outwardly from the top towards the bottom.

18. The device of claim 17 wherein the tapered section accounts for at least 5% of the height of the pit.

19. The device of claim 18 wherein the wall is substantially parallel to the axis of the pit below the tapered section, the axis passing through a center of the pit.

20. A pit for installation in the ground to house utility items, plumbing devices, valves or meters, the pit comprising:

a wall defining inner and outer surfaces and extending between top and bottom ends and defining an inner opening extending between the top and bottom ends;

a footing having a height and located at the bottom end of the wall and further having a face, the face defining a surface transverse to an axis of the wall and the face further including inner and outer edges;

wherein said wall and said footing are formed by injection molding;

a top section of the wall having a width less than a distance between the inner and outer edges;

a plurality of ribs positioned along the wall and extending inwardly, a rib thickness measured from the outer surface to an innermost section of the rib, a rib width measured at a base of the rib at the inner surface of the wall, the rib width being greater than a wall thickness between the inner and outer surfaces between two of said plurality of ribs by at least 5%; and the outer surface between two of the plurality of ribs is smooth.

21. The pit of claim 20 further comprising the rib width being greater than the wall thickness between the inner and outer surfaces between two of said plurality of ribs by at least 10%.

22. The pit of claim 20 further comprising the rib width being greater than the wall thickness between the inner and outer surfaces between two of said plurality of ribs by at least 18%.

* * * * *